US011204571B2

(12) United States Patent
Wakatsu et al.

(10) Patent No.: US 11,204,571 B2
(45) Date of Patent: Dec. 21, 2021

(54) HEATING APPARATUS INCLUDING A PLURALITY OF HEAT GENERATING ELEMENTS, FIXING APPARATUS, AND IMAGE FORMING APPARATUS

(71) Applicant: CANON KABUSHIKI KAISHA, Tokyo (JP)

(72) Inventors: Kohei Wakatsu, Kawasaki (JP); Tsuguhiro Yoshida, Yokohama (JP); Kazuhiro Doda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/008,399

(22) Filed: Aug. 31, 2020

(65) Prior Publication Data

US 2021/0072681 A1 Mar. 11, 2021

(30) Foreign Application Priority Data

Sep. 6, 2019 (JP) ..... JP2019-162956

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/2064* (2013.01); *G03G 15/5004* (2013.01); *G03G 15/80* (2013.01); *G03G 2215/2038* (2013.01)

(58) Field of Classification Search
CPC ..... G03G 15/2039; G03G 15/2053; G03G 15/2064; G03G 15/5004; G03G 15/80; G03G 2215/2038
See application file for complete search history.

(56) References Cited

U.S. PATENT DOCUMENTS

2008/0003008 A1* 1/2008 Takai ..... G03G 15/2039 399/69
2009/0196643 A1* 8/2009 Mito ..... G03G 15/2039 399/69
2012/0237248 A1* 9/2012 Aoki ..... G03G 15/5004 399/88

FOREIGN PATENT DOCUMENTS

JP 4795039 B2 10/2011

* cited by examiner

*Primary Examiner* — Gregory H Curran
(74) *Attorney, Agent, or Firm* — Canon U.S.A., Inc. I.P. Division

(57) ABSTRACT

A heating apparatus to heat an image borne on a recording material includes a heater having a heater portion with first and second heating elements, where the heating elements have different lengths and resistance values. The heating apparatus also includes a power source, a switching unit, a control unit, and a voltage detection unit. The power source supplies power to the heating elements. The control unit controls the switching unit two switch a connection between the power source and the first heating element and the second heating element. The voltage detection unit detects an input voltage input from the power source to the heating elements. The control unit switches a power ratio, which is a ratio between an electric energy supplied from the power source to the first heating element and an electric energy supplied from the power source to the second heating element, depending on the detected input voltage.

15 Claims, 14 Drawing Sheets

HEATING APPARATUS INCLUDING A PLURALITY OF HEAT GENERATING ELEMENTS, FIXING APPARATUS, AND IMAGE FORMING APPARATUS

BACKGROUND

Field of the Disclosure

The present disclosure relates to a heating apparatus, a fixing apparatus, and an image forming apparatus, and more particularly, to power supply control of a heating apparatus.

Description of the Related Art

In image forming apparatus, for example, copying machines and printers, which employ an electrophotographic system, there is widely used a fixing apparatus configured to heat toner transferred onto a sheet to fix a toner image to the sheet. In the fixing apparatus, when sheets having a width narrower than the width of a heater are continuously printed, there occurs a phenomenon called "non-sheet-passing portion temperature rise", in which the temperature of the fixing apparatus gradually rises in an end portion area (non-sheet-passing portion) of the heater in a longitudinal direction thereof, through which the sheet does not pass. In this case, the non-sheet-passing portion temperature rise refers to a phenomenon in which the temperature rises in the non-sheet-passing portion in which the heat generating element and the sheet are not in contact with each other when fixing processing is being performed on a sheet P having a width shorter than the length of a heat generating element in the longitudinal direction. When the non-sheet-passing portion temperature rise becomes conspicuous, damage may be caused to components of the fixing apparatus, which includes a film configured to heat the sheet in the fixing apparatus and a pressure roller configured to press the sheet passing through a nip portion between the pressure roller and the film. In view of this, there is proposed a configuration for reducing the non-sheet-passing portion temperature rise by changing a heat generation ratio between the center and the end portion of the heater of the fixing apparatus in the longitudinal direction. For example, in Japanese Patent No. 4795039, there is disclosed a configuration for changing the heat generation ratio between the center and the end portion of the heater by switching a power ratio between two heat generating elements provided to the heater depending on a degree to which the heater of the fixing apparatus has been heated.

However, when an input voltage to the heater changes, a desired temperature distribution in the longitudinal direction of the heater may not be obtained. There is described an exemplary case in which power to be supplied to a large-sized heat generating element for the letter (LTR) and A4 sizes, which is configured to heat an entire area in the longitudinal direction, is increased and power to be supplied to a small-sized heat generating element for the A5 size smaller in width in the longitudinal direction is reduced. In order to suppress the non-sheet-passing portion temperature rise caused when an A5-size sheet is passed to maximize throughput, the power ratio of the small-sized heat generating element is increased in advance as much as possible. When the input voltage decreases, power required for heating the sheet becomes insufficient, and the temperature of the film at the center in the longitudinal direction, through which the sheet passes, decreases. Here, the toner on the sheet is not melted and a poor fixing occurs.

SUMMARY

According to an aspect of the present disclosure, a heating apparatus configured to heat an image borne on a recording material includes a heater portion including a plurality of heat generating elements, which includes a first heat generating element and a second heat generating element, which has a length shorter than a length of the first heat generating element in a longitudinal direction, and has a resistance value larger than a resistance value of the first heat generating element in an entirety, a power source configured to supply power to the plurality of heat generating elements of the heater portion, a switching unit configured to switch a connection between the power source and at least one of the first heat generating element or the second heat generating element, a control unit configured to control the switching unit to switch power supply to the plurality of heat generating elements, and a voltage detection unit configured to detect an input voltage input from the power source to the plurality of heat generating elements, wherein the control unit is configured to switch a power ratio, which is a ratio between an electric energy supplied from the power source to the first heat generating element and an electric energy supplied from the power source to the second heat generating element, depending on the input voltage detected by the voltage detection unit.

Further features and aspects of the present disclosure will become apparent from the following description of exemplary embodiments with reference to the attached drawings.

DESCRIPTION OF THE EMBODIMENTS

Embodiments of the present disclosure are described in detail below with reference to the drawings. In the following Embodiments, running a recording sheet through a fixing nip portion is referred to as "passing a sheet". An area in which a heat generating element generates heat and through which a recording sheet does not pass is referred to as "non-sheet-passing area" ("non-sheet-passing portion" or "area outside the sheet passing area"). An area in which a heat generating element generates heat and through which a recording sheet passes is referred to as "sheet passing area" ("sheet passing portion"). A phenomenon in which the temperature in the non-sheet-passing area rises higher than the temperature in the sheet passing area is referred to as "temperature rise in a non-sheet-passing portion".

Embodiment 1

<Overall Configuration>

Figure 1:
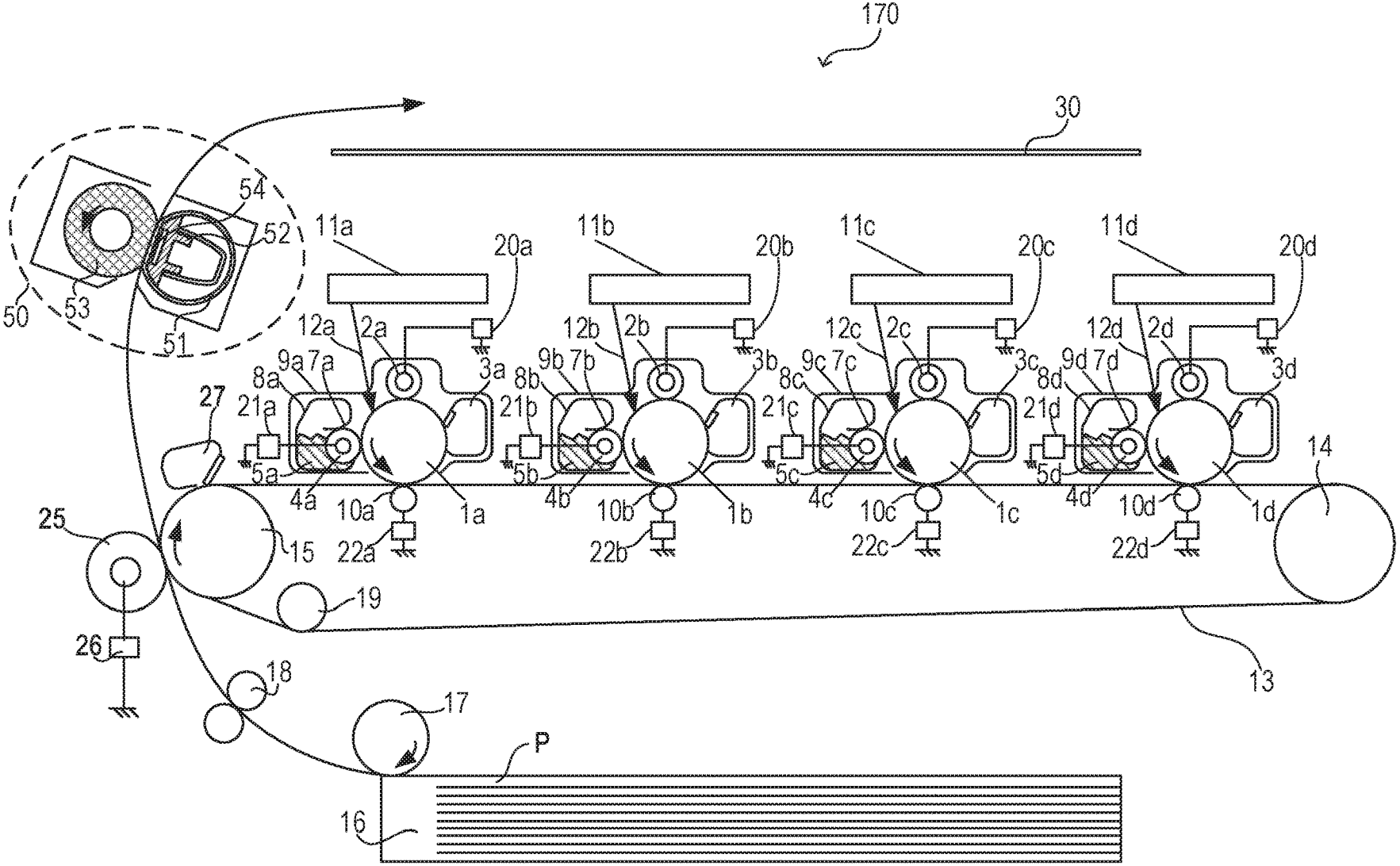
FIG. 1 is an overall configuration diagram of an image forming apparatus according to each of Examples 1 and 2.

FIG. 1 is a diagram for illustrating a configuration of an in-line color-image forming apparatus 170, which is an example of an image forming apparatus 170 with a fixing apparatus installed therein according to Embodiment 1 of the present disclosure. The operation of the color-image forming apparatus 170 as an electrophotographic apparatus is described with reference to FIG. 1. A first station is a station for forming a yellow (Y) color toner image, and a second station is a station for forming a magenta (M) color toner image. A third station is a station for forming a cyan (C) color toner image, and a fourth station is a station for forming a black (K) color toner image.

At the first station, a photosensitive drum 1*a*, which is an image bearing member, is an OPC photosensitive drum. The photosensitive drum 1*a* is a metal cylinder on which a plurality of layers of functional organic materials are laminated. The plurality of layers include a carrier generation layer, which generates electric charges by photosensitivity, a charge transport layer, through which the generated electric charges are transported, and others, and the outermost layer of the plurality of layers is so low in electrical conductance that the outermost layer is substantially insulating. A charging roller 2*a*, which is a charging unit, is brought into contact with the photosensitive drum 1*a*, and follows the rotation of the photosensitive drum 1*a* to rotate and uniformly charge a surface of the photosensitive drum 1*a* during the rotation. A voltage on which a direct-current voltage or an alternating current voltage is superposed is applied to the charging roller 2*a*, and the resultant electric discharge occurring in minute air gaps on the upstream side and the downstream side in the direction of the rotation from a nip portion between the charging roller 2*a* and the surface of the photosensitive drum 1*a* charges the photosensitive drum 1*a*. A cleaning unit 3*a* is a unit configured to clean toner remaining on the photosensitive drum 1*a* after transfer, which is described later. A developing unit 8*a*, which is a unit configured to develop an image, includes a developing roller 4*a*, a non-magnetic one-component toner 5*a*, and a developer application blade 7*a*. The photosensitive drum 1*a*, the charging roller 2*a*, the cleaning unit 3*a*, and the developing unit 8*a* are in an integrated process cartridge 9*a*, which can freely be attached to and detached from the image forming apparatus 170.

An exposure device 1*a*, which is an exposure unit, includes a scanner unit using a polygonal mirror to scan laser light, or a light emitting diode (LED) array, and radiates a scanning beam 12*a*, which is modulated based on an image signal, on the photosensitive drum 1*a*. The charging roller 2*a* is connected to a charging high-voltage power source 20*a*, which is a unit configured to supply a voltage to the charging roller 2*a*. The developing roller 4*a* is connected to a development high-voltage power source 21*a*, which is a unit configured to supply a voltage to the developing roller 4*a*. A primary transfer roller 10*a* is connected to a primary transfer high-voltage power source 22*a*, which is a unit configured to supply a voltage to the primary transfer roller 10*a*. This concludes the description on the configuration of the first station, and the second, third, and fourth stations have the same configuration as that of the first station. In the other stations, parts having the same functions as those of the parts in the first station are denoted by the same reference symbols, with one of suffixes "b", "c", and "d" attached to the reference symbols for each station. The suffixes "a", "b", "c", and "d" are omitted in the following description, except for when a specific station is described.

An intermediate transfer belt 13 is supported by three rollers: a secondary transfer counter roller 15, a tension roller 14, and an auxiliary roller 19, which serve as tension members for the intermediate transfer belt 13. A force from a spring (not shown) is applied to the tension roller 14 alone in a direction that causes the intermediate transfer belt 13 to stretch, so that an appropriate tensional force is maintained in the intermediate transfer belt 13. The secondary transfer counter roller 15 is rotationally driven by a main motor (not shown) to rotate, which causes the intermediate transfer belt 13 wound around the outer circumference of the secondary transfer counter roller 15 to turn. The intermediate transfer belt 13 moves in a forward direction (for example, the clockwise direction in FIG. 1) in relation to the photosensitive drums 1*a* to 1*d* (rotating, for example, in the counterclockwise direction in FIG. 1) at substantially the same speed. The intermediate transfer belt 13 also rotates in the direction of the arrow (the clockwise direction), and the primary transfer roller 10 placed on the opposite side from the photosensitive drum 1 across the intermediate transfer belt 13 follows the movement of the intermediate transfer belt 13 to rotate. A position at which the photosensitive drum 1 and the primary transfer roller 10 come into contact with each other with the intermediate transfer belt 13 interposed therebetween is referred to as "primary transfer position". The auxiliary roller 19, the tension roller 14, and the secondary transfer counter roller 15 are electrically grounded. The primary transfer rollers 10*b* to 10*d* in the second to fourth stations have the same configuration as that of the primary transfer roller 10*a* in the first station, and description thereof is therefore omitted.

Image forming operation of the image forming apparatus 170 according to Embodiment 1 is described next. The image forming apparatus 170 starts image forming operation when receiving a print command in a standby state. The main motor (not shown) causes the photosensitive drums 1, the intermediate transfer belt 13, and others to start rotating in the directions of the arrows at a given process speed. The photosensitive drum 1*a* is uniformly charged by the charging roller 2*a*, to which a voltage has been applied by the charging high-voltage power source 20*a*, and an electrostatic latent image based on image information is subsequently formed with the scanning beam 12*a* radiated from the exposure device 1*a*. The toner 5*a* inside the developing unit 8*a* is charged to have a negative polarity by the developer application blade 7*a*, and then applied to the developing roller 4*a*. A given development voltage is supplied to the developing roller 4*a* from the development high-voltage power source 21*a*. With the rotation of the photosensitive drum 1*a*, the electrostatic latent image formed on the photosensitive drum 1*a* reaches the developing roller 4*a*, at which the negative toner adheres to the electrostatic latent image, to thereby turn the latent image into a visible toner image that is formed in the first color (for example, yellow (Y)) on the photosensitive drum 1*a*. The same operation is executed at the stations (the process cartridges 9*b* to 9*d*) of the other colors (magenta (M), cyan (C), and black (K)) as well. An electrostatic latent image is formed on each of the photosensitive drums 1*a* to 1*d* by exposure, with a write signal from a controller (not shown) delayed at fixed timing that is based on the distance between the primary transfer position of one color and the primary transfer position of another color. A direct-current high voltage having a polarity opposite to that of the toner is applied to each of the primary transfer rollers 10*a* to 10*d*. Through the steps described above, toner images are sequentially transferred to the intermediate transfer belt 13 (hereinafter referred to as "primary transfer") to form a multiple toner image on the intermediate transfer belt 13.

Thereafter, a sheet P, which is one of recording materials stacked in a cassette 16, is fed (picked up) by a sheet feeding roller 17, which is rotationally driven by a sheet feeding solenoid (not shown). The fed sheet P is conveyed by a conveying roller to registration rollers 18. The sheet P is conveyed by the registration rollers 18 to a transfer nip portion at which the intermediate transfer belt 13 and the secondary transfer roller 25 come into contact with each other, in synchronization with the toner image on the intermediate transfer belt 13. A voltage having a polarity opposite to that of the tone is applied to the secondary transfer roller 25 by the secondary transfer high-voltage power source 26 to transfer the multiple toner image borne on the intermediate transfer belt 13, which is a stack of toner images each having one of four colors, at once onto the sheet P (a recording material)(hereinafter referred to as "secondary transfer"). The members that have participated up through the forming of an unfixed toner image on the sheet P (for example, the photosensitive drums 1) function as an image forming unit. The toner remaining on the intermediate transfer belt 13 after the secondary transfer is finished is cleaned off by the cleaning unit 27. The sheet P after the completion of the secondary transfer is conveyed to a fixing apparatus 50, which is a fixing unit, and once the toner image is fixed, is discharged as an image-formed product (a print or a copy) to a discharge tray 30. A film 51, nip forming member 52, pressure roller 53, and heater 54 of the fixing apparatus 50 are described later.

[Control Block Diagram of Image Forming Apparatus]

Figure 2:
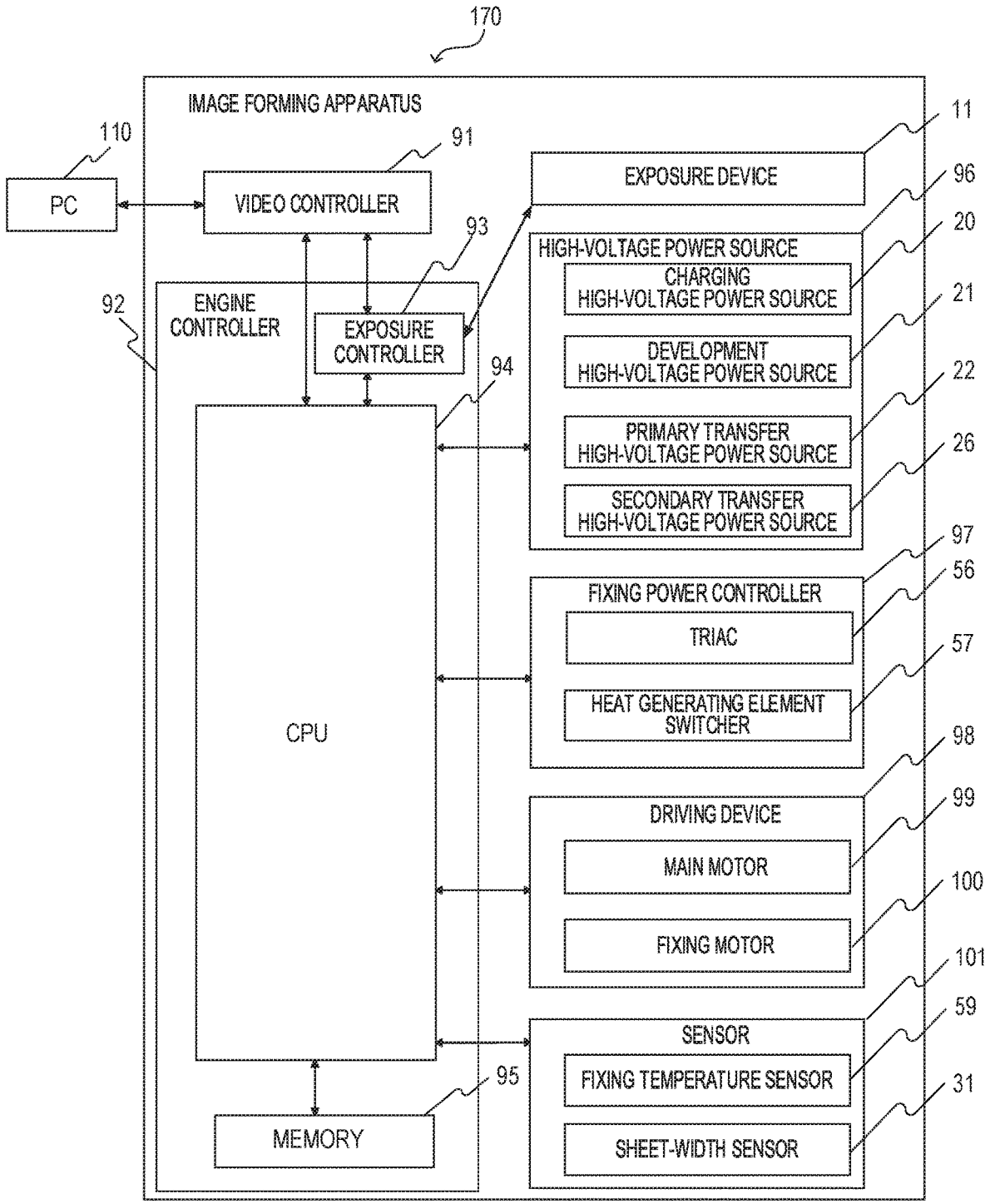
FIG. 2 is a control block diagram of the image forming apparatus according to Embodiment 1.

FIG. 2 is a block diagram for illustrating a configuration of a control section, and is a diagram for illustrating the operation of the image forming apparatus 170, and printing operation of the image forming apparatus 170 is described with reference to FIG. 2. A PC 110 serving as a host computer has the role of outputting a print command to a video controller 91, which is located inside the image forming apparatus 170, and transferring image data of a print image to the video controller 91.

The video controller 91 converts the image data input from the PC 110 into exposure data, and transfers the exposure data to an exposure controller 93 located inside the engine controller 92. The exposure controller 93 is controlled by a CPU 94 to control the exposure device 11 configured to turn on/off a laser beam in accordance with the exposure data. The CPU 94, which is a control unit, starts an image forming sequence when receiving the print command.

An engine controller 92 in which a CPU 94, a memory 95, and others are installed executes pre-programmed operation. The CPU 94 includes a timer configured to measure a time. A high-voltage power source 96 is formed of the charging high-voltage power source 20, the development high-voltage power source 21, the primary transfer high-voltage power source 22, and the secondary transfer high-voltage power source 26, which are described above. In addition, a fixing power controller 97 is formed of, for example, a bidirectional thyristor (hereinafter referred to as "TRIAC") 56, which is a supply control portion, and a heat generating element switcher 57, which serves as a switching unit configured to exclusively select a heat generating element configured to supply power. The fixing power controller 97 selects a heat generating element that generates heat in the fixing apparatus 50, and determines an electric energy to be supplied. A driving device 98 includes a main motor 99, a fixing motor 100, and others. A sensor 101 includes a fixing temperature sensor 59, which serves as a temperature detection unit configured to detect the temperature of the fixing apparatus 50, a sheet-width sensor 31, which is configured to detect the width of the sheet P, and others. Detection results of the sensor 101 are transmitted to the CPU 94. The CPU 94 obtains the detection results of the sensor 101 in the image forming apparatus 170 to control the exposure device 11, the high-voltage power source 96, the fixing power controller 97, and the driving device 98. The CPU 94 thus controls an image forming step in which the forming of an electrostatic latent image, the transfer of a developed toner image, and the fixing of the toner image to the sheet P are executed to print exposure data as a toner image on the sheet P. An image forming apparatus to which Embodiment 1 is applied is not limited to the image forming apparatus 170 that has the configuration illustrated in FIG. 1, and can be any image forming apparatus as long as printing on sheets P of varying widths is executable and the image forming apparatus includes the fixing apparatus 50 that includes the heater 54 described later.

[Configuration of Fixing Apparatus]

Next, a configuration of the fixing apparatus 50 according to Embodiment 1, in which heat generating elements are used to control a heating apparatus configured to heat the toner image on the sheet P, is described with reference to FIG. 3. The longitudinal direction is a rotation axis direction of the pressure roller 53 described later, which is substantially orthogonal to the conveyance direction of the sheet P. The length of the sheet P in the direction (the longitudinal direction) substantially orthogonal to the conveyance direction are referred to as "widths".

Figure 3:
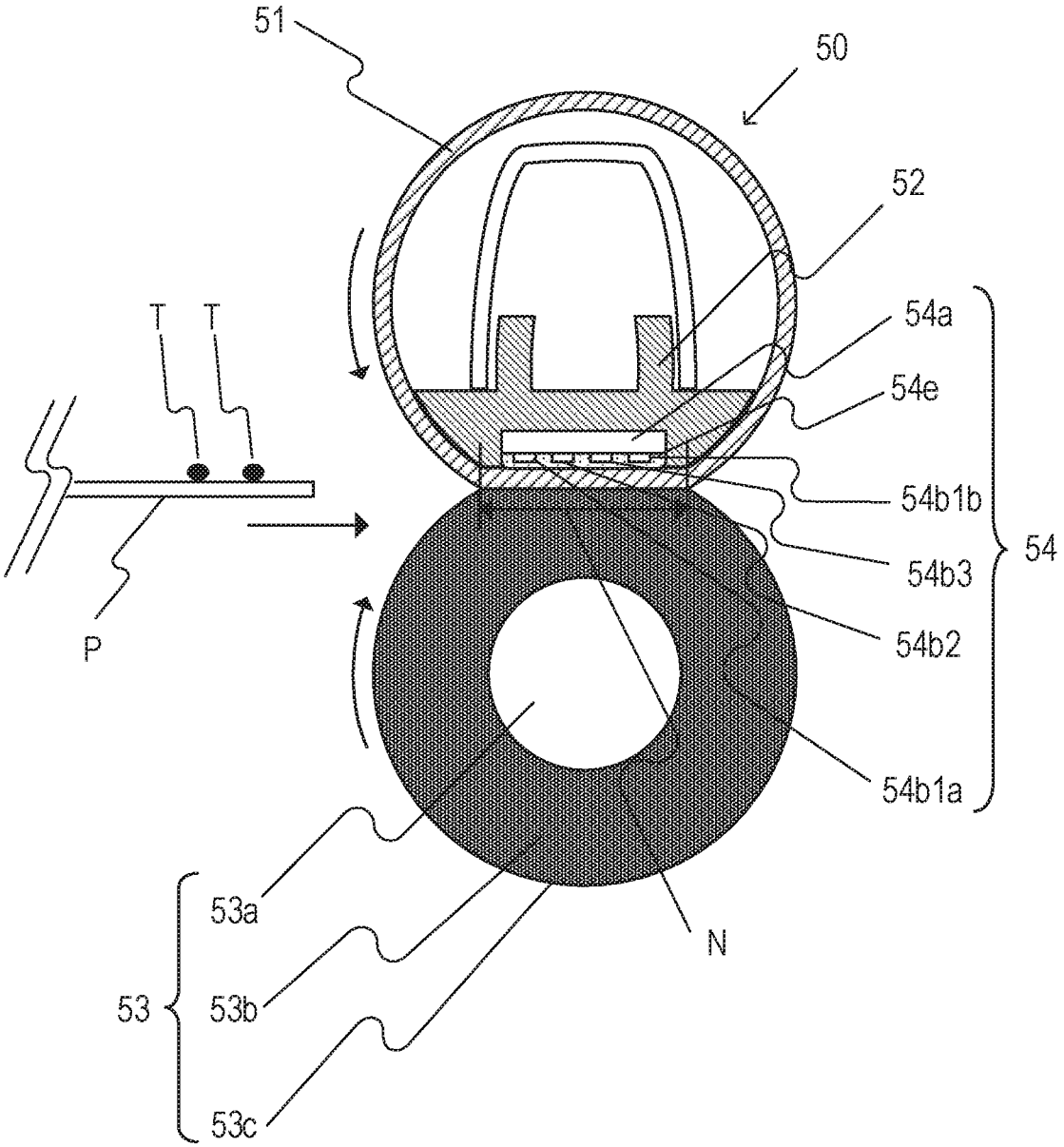
FIG. 3 is a schematic cross-sectional view of the vicinity of a central portion of a fixing apparatus according to each of Embodiments 1 and 2 in a longitudinal direction thereof.

FIG. 3 is a schematic sectional view of the fixing apparatus 50. The sheet P holding an unfixed toner image T is conveyed from the left hand side toward the right hand side in FIG. 3, and is heated in a fixing nip portion N during the conveyance, to thereby fix the toner image T to the sheet P. The fixing device 50 in Embodiment 1 includes the film 51 shaped into a tube, the nip forming member 52 configured to hold the film 51, the pressure roller 53, which forms the fixing nip portion N together with the film 51, and the heater 54 (heater unit) for heating the sheet P.

The film 51 (first rotary member) is a fixing film serving as a heating rotary member. In Embodiment 1, the film 51 has a base layer made of, for example, polyimide. On the base layer, an elastic layer is made of silicone rubber and a release layer is made of PFA. The inner surface of the film 51 is coated with grease in order to reduce a frictional force generated between the nip forming member 52, the heater 54, and the film 51 by the rotation of the film 51.

The nip forming member 52 plays the role of guiding the film 51 from the inside and forming the fixing nip portion N between the nip forming member 52 and the pressure roller 53 via the film 51. The nip forming member 52 is a member that has rigidity, heat resistance, and heat insulation, and is formed of liquid crystal polymer or the like. The film 51 is fit to the exterior of the nip forming member 52. The pressure roller 53 (second rotary member) is a roller serving as a pressurizing rotary member. The pressure roller 53 includes a metal core 53*a*, an elastic layer 53*b*, and a release layer 53*c*. The pressure roller 53 is rotatably held at both ends, and is rotationally driven by the fixing motor 100 (see FIG. 2). The film 51 follows the rotation of the pressure roller 53 to rotate. The heater 54, which is a heating member, is held by the nip forming member 52 so as to be in contact with the inner surface of the film 51. The heater 54 and the fixing temperature sensor 59 are described later.

[Configuration of Heater]

Figure 4:
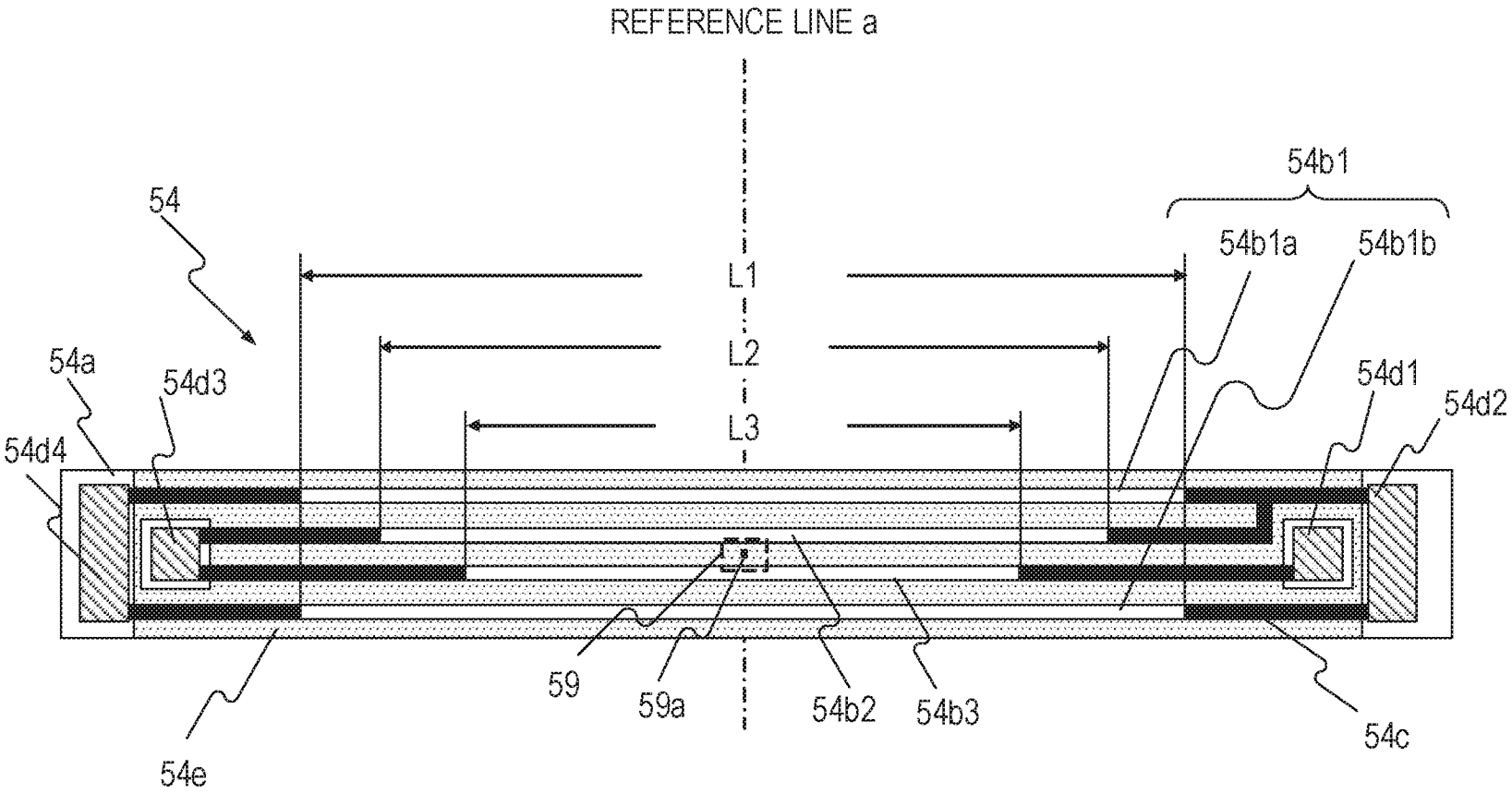
FIG. 4 is a schematic view for illustrating a configuration of a heater in each of Embodiments 1 and 2.

Next, the heater 54 is described in detail with reference to FIG. 4 and FIG. 5. FIG. 4 is a schematic view for illustrating a configuration of the heater 54 when the heater 54 in which the heat generating elements are arranged is viewed from above. In FIG. 4, a reference line "a" is the center line of heat generating elements 54*b*1*a*, 54*b*1*b*, 54*b*2, and 54*b*3 in a longitudinal direction thereof, and is also the center line of the sheet P which is to be conveyed to the fixing apparatus 50, in the longitudinal direction. As illustrated in FIG. 4, the heater 54 includes a substrate 54*a*, the heat generating elements 54*b*1*a*, 54*b*1*b*, 54*b*2, and 54*b*3, conductors 54*c*, contacts 54*d*1 to 54*d*4, and a protective glass layer 54*e*. The conductors 54*c* are indicated by the solid black areas in FIG. 4. The substrate 54*a* in Embodiment 1 is made of alumina ($Al_2O_3$) being ceramics. Materials of the ceramic substrate may include, for example, alumina ($Al_2O_3$), aluminum nitride (AlN), zirconia ($ZrO_2$), and silicon carbide (SiC). Among those materials, alumina ($Al_2O_3$) is low in price and can be obtained with ease. Moreover, a metal which is excellent in strength may be used for the substrate 54*a*, and stainless steel (SUS) is excellent in price and strength and thus is suitably used for a metal substrate. In a case in which any of a ceramic substrate and a metal substrate is used as the substrate 54*a*, and the substrate has conductivity, it is required that the substrate be used with an insulating layer provided thereto. The heat generating elements 54*b*1*a*, 54*b*1*b*, 54*b*2, and 54*b*3, the conductor 54*c*, and the contacts 54*d*1 to 54*d*4 are formed on the substrate 54*a*. Further, the protection glass layer 54*e* is formed thereon to secure insulation between each of the heat generating elements 54*b*1*a*, 54*b*1*b*, 54*b*2, and 54*b*3 and a film 51.

The heat generating elements differ from one another in length in the longitudinal direction (length in the left-right direction in FIG. 4). That is, the heat generating elements 54*b*1*a* and 54*b*1*b* have a length L1 of 222 mm in the longitudinal direction, the heat generating element 54*b*2 has a length L2 of 188 mm in the longitudinal direction, and the heat generating element 54*b*3 has a length L3 of 154 mm in the longitudinal direction. The magnitude relationship among the lengths L1, L2, and L3 in the longitudinal direction is L1>L2>L3. For example, it is assumed that the heat generating elements 54*b*1 are used when the sheet P to be used is an A4-size sheet, the heat generating element 54*b*2 is mainly used when the sheet P to be used is a B5-size sheet, and the heat generating element 54*b*3 is mainly used when the sheet P to be used is an A5-size sheet.

As illustrated in FIG. 4, each of the heat generating elements 54*b*1*a* and 54*b*1*b*, which is a first heat generating element, has one end connected to the contact 54*d*2 (first contact) and the other end connected to the contact 54*d*4 (fourth contact), electrically via the conductors 54*c*. In addition, the heat generating element 54*b*2 has one end connected to the contact 54*d*2 and the other end connected to the contact 54*d*3, electrically via the conductors 54*c*. In the same manner, the heat generating element 54*b*3 has one end connected to the contact 54*d*1 (second contact) and the other end connected to the contact 54*d*3 (third contact), electrically via the conductors 54*c*. In this case, as illustrated in FIG. 4, the lengths L1 of the heat generating element 54*b*1*a* and the heat generating element 54*b*1*b* in the longitudinal direction are the same length, and those two heat generating elements can be always used simultaneously in the case of being used. In the following description, the pair of the heat generating elements 54*b*1*a* and 54*b*1*b* are collectively referred to as "heat generating elements 54*b*1". Meanwhile, as illustrated in FIG. 4, the heat generating elements 54*b*1, 54*b*2, and 54*b*3 overlap one another in the longitudinal direction.

As illustrated in FIG. 4, the heat generating element 54*b*2 (second heat generating element) and the heat generating element 54*b*3 (third heat generating element) are arranged asymmetrically in a widthwise direction of the substrate 54*a*, and when the heat generating elements 54*b*2 and 54*b*3 generate heat, an asymmetric temperature gradient is formed in the widthwise direction of the substrate 54*a*. This may lead to a case in which a thermal stress for deforming one end of the substrate 54*a* may be applied when a maximum power is applied to the heat generating elements 54*b*2 and 54*b*3 for a fixed time or longer due to, for example, an unexpected failure. In view of this, in Embodiment 1, the maximum power per unit length of the heat generating elements 54*b*2 and 54*b*3 is reduced, to thereby cause the thermal stress applied to the substrate 54*a* to fall within a fixed range. Meanwhile, the heat generating elements 54*b*1 has a resistance value that maximizes the maximum power per unit length in order to raise the temperature of the fixing apparatus 50 to a temperature at which the sheet P can be passed in a short time. As illustrated in FIG. 4, the heat generating elements 54*b* are arranged bilaterally symmetrically with respect to the widthwise direction of the substrate 54*a*, and hence a thermal stress is unlikely to occur, to thereby allow the maximum power to be set large. In Embodiment 1, the resistance values of the heat generating elements 54*b*1, 54*b*2, and 54*b*3 (resistance values of the entire heat generating elements) are set to 10Ω, 30Ω, and 30Ω, respectively. The resistance value of the heat generating elements 54*b*1 is a combined resistance value of the resistances of the two heat generating elements 54*b*1*a* and 54*b*1*b*. The maximum power per unit length of each heat generating element can be expressed by (power)/(heat generating element length)=((input voltage)$^2$/(resistance value))/(heat generating element length). For example, in Embodiment 1, when the input voltage is 120 V, the maximum power per unit length (1 m) of each heat generating element is 6,486 W/m for the heat generating elements 54*b*1, 2,553 W/m for the heat generating element 54*b*2, and 3,117 W/m for the heat generating element 54*b*3. In this manner, the heat generating elements 54*b*1 and the heat generating elements 54*b*2 and 54*b*3 are caused to differ from each other in maximum power per unit length.

[Fixing Temperature Sensor]

Figure 5:
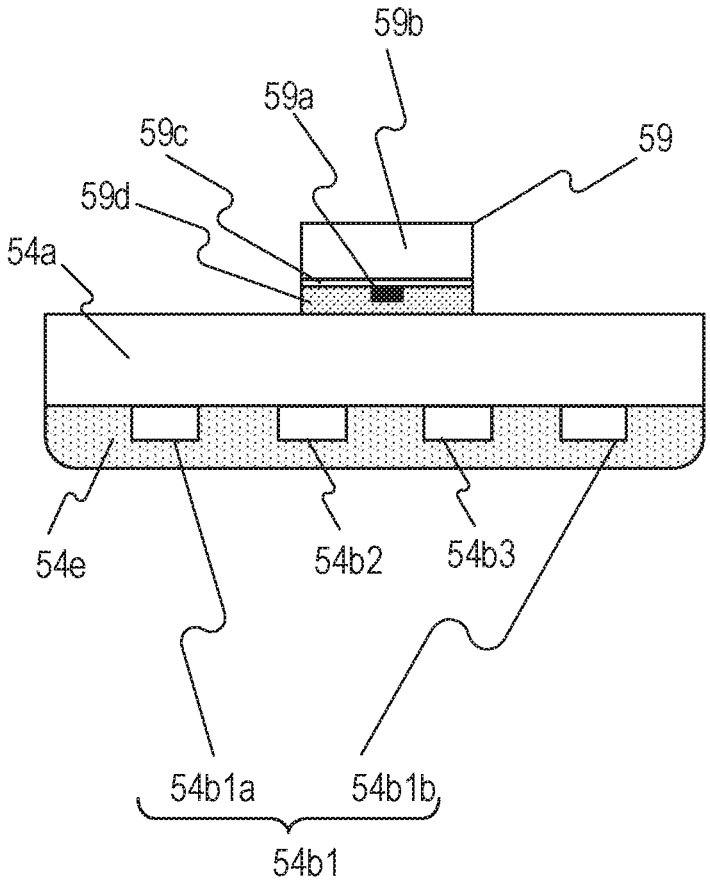
FIG. 5 is a schematic view for illustrating a cross-section of the heater in each of Embodiments 1 and 2.

FIG. 5 is a schematic view for illustrating a cross-section of the heater 54 exhibited when the heater 54 illustrated in FIG. 4 is cut along the center line (reference line "a" of FIG. 4) of the sheet P, which is to be conveyed to the fixing apparatus 50, in the longitudinal direction. The fixing temperature sensor 59 includes a thermistor element 59*a*, a holder 59*b*, a ceramic paper 59*c* having a function of inhibiting heat conduction between the holder 59*b* and the thermistor element 59*a*, and an insulating resin sheet 59*d* having a function of physically and electrically protecting the thermistor element 59*a*. The thermistor element 59*a* is a temperature detection unit having a resistance value and an output value (voltage) changed depending on the temperature of the heater 54, and is connected to the CPU 94 by a Dumet wire and a wiring (not shown). The thermistor element 59*a* is configured to output a voltage being a detection result to the CPU 94 based on the temperature of the heater 54. The CPU 94 controls the temperature of the heater 54 based on the temperature detection result obtained by the fixing temperature sensor 59. The fixing temperature sensor 59 is in contact with the substrate 54*a* on a surface opposite to the protective glass layer 54*e*. In addition, the heat generating elements 54*b*1*a*, 54*b*1*b*, 54*b*2, and 54*b*3 covered with the protective glass layer 54*e* are arranged on a surface opposite to the surface of the substrate 54*a* on which the fixing temperature sensor 59 is mounted.

In FIG. 4, the dotted line indicating the fixing temperature sensor 59 shows that the fixing temperature sensor 59 is arranged on the back surface of the substrate 54*a*, and indicates a position at which the fixing temperature sensor 59 is in abutment with the substrate 54*a*. The thermistor element 59*a* is arranged on the reference line "a" being the center line of the heat generating elements 54*b*1, 54*b*2, and 54*b*3 in the longitudinal direction and being the center line of the sheet P to be conveyed to the fixing apparatus 50.

[Configuration of Power Control Circuit]

Figure 6:
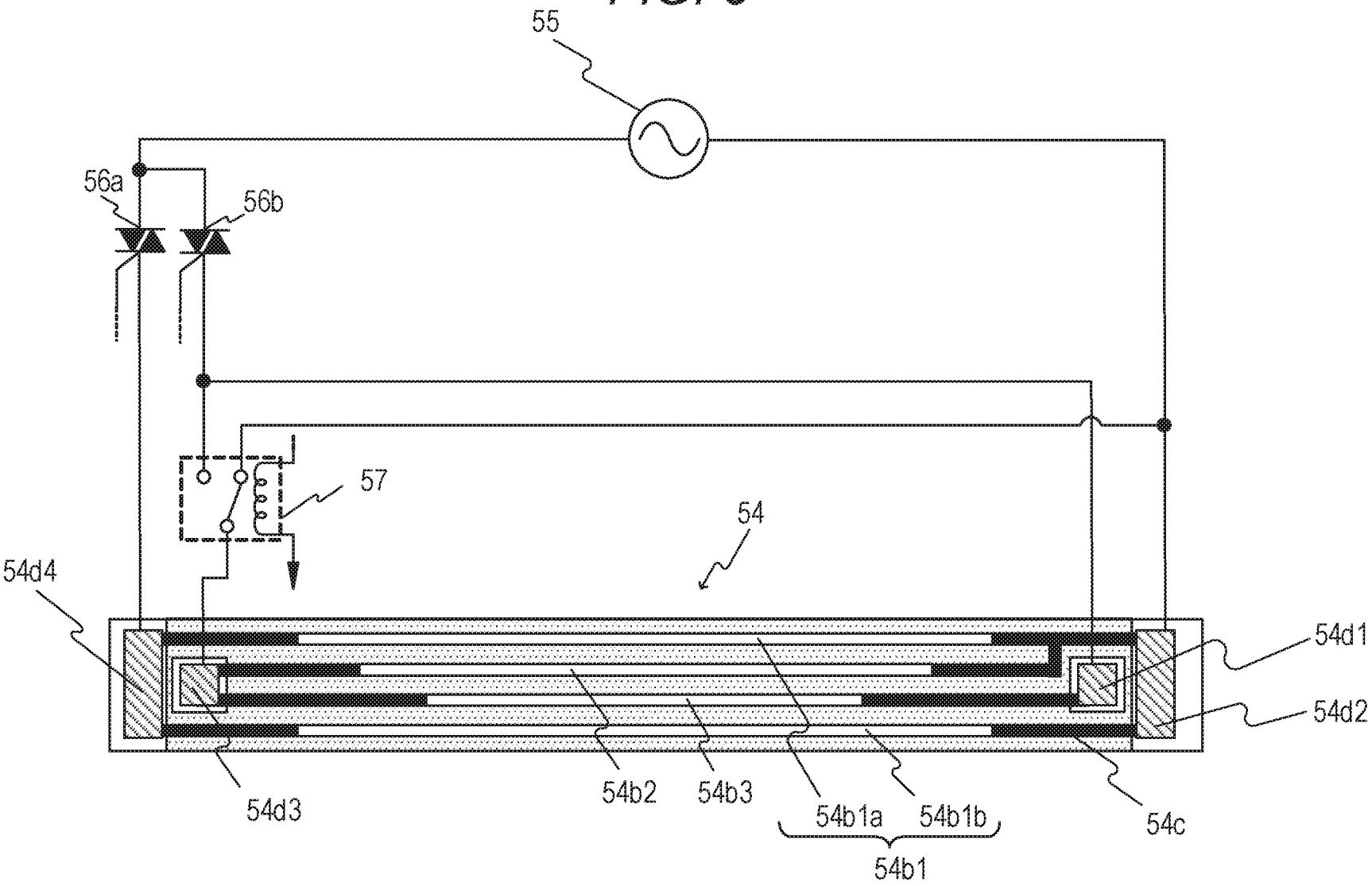
FIG. 6 is a schematic view of a power control circuit of the fixing apparatus according to Embodiment 1.

FIG. 6 is a schematic view for illustrating a configuration of a power control circuit of the fixing apparatus 50. The fixing apparatus 50 according to Embodiment 1 is configured to control a power ratio among the heat generating elements 54*b*1, 54*b*2, and 54*b*3 based on the size of the sheet P to form a desired temperature distribution of the heater 54 in the longitudinal direction. In this case, the power ratio refers to a ratio (rate) among times for supplying power from an AC power source 55 to the heat generating elements 54*b*1, 54*b*2, and 54*b*3.

The power control circuit of the fixing apparatus 50 includes: the TRIACs 56*a* and 56*b* configured to connect or disconnect power supply routes from the AC power source 55 to the heat generating elements 54*b*1, 54*b*2, and 54*b*3; and the heat generating element switcher 57 configured to switch the heat generating element to which the power is to be supplied. In the following description, the heat generating element switcher 57 is referred to as "switcher 57". The TRIAC 56*a* is configured to connect (turn on) or disconnect (turn off) the power supply route between the AC power source 55 and the contact 54*d*4 of the heater 54. Meanwhile, the TRIAC 56*b* is configured to connect (turn on) or disconnect (turn off) the power supply route between the AC power source 55 and the switcher 57 or between the AC power source 55 and the contact 54*d*1 of the heater 54. The switcher 57 is a C-contact relay serving as a heat generating element control unit configured to control the power supply to a plurality of heat generating elements, and is configured to switch the contact 54*d*3 of the heater 54 so as to be connected to the TRIAC 56*b* or the AC power source 55. The contact 54*d*2 of the heater 54 is constantly connected to the AC power source 55.

For example, when power is to be supplied from the AC power source 55 to the heat generating elements 54*b*1, the TRIAC 56*a* is turned on to connect the AC power source 55 to the contact 54*d*4 of the heater 54, and the TRIAC 56*b* is turned off. Thus, the heat generating elements 54*b*1 (54*b*1*a* and 54*b*1*b*) are connected to the AC power source 55 via the contacts 54*d*2 and 54*d*4 of the heater 54. When power is to be supplied from the AC power source 55 to the heat generating element 54*b*2, the TRIAC 56*b* is turned on to connect the AC power source 55 to the switcher 57, and the switcher 57 is controlled so as to connect the contact 54*d*3 of the heater 54 to the TRIAC 56*b*. In addition, the TRIAC 56*a* is turned off. Thus, one end of the heat generating element 54*b*2 is connected to the AC power source 55 via the contact 54*d*3 of the heater 54, the switcher 57, and the TRIAC 56*b*, and the other end of the heat generating element 54*b*2 is connected to the AC power source 55 via the contact 54*d*2 of the heater 54. When power is to be supplied from the AC power source 55 to the heat generating element 54*b*3, the TRIAC 56*b* is turned on, and the switcher 57 is controlled so as to connect the contact 54*d*3 of the heater 54 to the AC power source 55. In addition, the TRIAC 56*a* is turned off. Thus, one end of the heat generating element 54*b*3 is connected to the AC power source 55 via the contact 54*d*3 of the heater 54 and the switcher 57, and the other end of the heat generating element 54*b*3 is connected to the AC power source 55 via the contact 54*d*1 of the heater 54 and the TRIAC 56*b*. The CPU 94 calculates an electric energy required for causing the temperature of the heater 54 to reach a target temperature suitable for image formation on the sheet P based on temperature information on the heater 54, which is detected by the fixing temperature sensor 59. In Embodiment 1, PI control is used for controlling the temperature of the heater 54, but the control method is not limited thereto.

In order to supply power at a power ratio for causing the temperature of the heater 54 to reach the target temperature, the CPU 94 controls the TRIACs 56*a* and 56*b* and the heat generating element switcher 57 to distribute a power supply time to the heat generating elements 54*b*1, 54*b*2, and 54*b*3. The power supply to the heat generating element may be switched every four periods of a power supply frequency of the AC power source 55. For example, it is assumed that one cycle of the power supply time is 10, a time ratio of power supply (hereinafter also referred to as "power ratio") to the heat generating elements 54*b*1*a* and 54*b*1*b* is 2, and a time ratio of power supply (power ratio) to the heat generating element 54*b*2 is 8. In this case, a state of supplying power by connecting the AC power source 55 to the heat generating elements 54*b*1 is continued during 8 periods (=(4 periods)×2). After that, the heat generating element that supplies power is switched, and a state of supplying power by connecting the AC power source 55 to the heat generating element 54*b*2 is continued during 32 periods (=(4 periods)×8). After that, the AC power source 55 is again connected to the heat generating elements 54*b*1. The above-mentioned operation is repeated. In Embodiment 1, the power supply time ratio (power ratio) can be switched from 10:0 to 0:10 while incrementing the power supply time ratio (power ratio) one by one.

In Embodiment 1, the power ratio for causing the temperature of the heater 54 to reach the target temperature is achieved by distributing the power supply time from the AC power source 55, but the method is not limited thereto. In the disclosure, the electric energy to be supplied to the heat generating elements may be distributed based on any one of time, voltage, and current, or a combination thereof. For example, as the heat generating element control unit, a desired power ratio may be achieved by providing a TRIAC to each heat generating element and causing the CPU 94 to switch each TRIAC between on and off to control the amount of current to be supplied to each heat generating element. In addition, the resolution of the ratio is not limited thereto.

[Obtaining of Input Voltage of AC Power Source]

Figure 7:
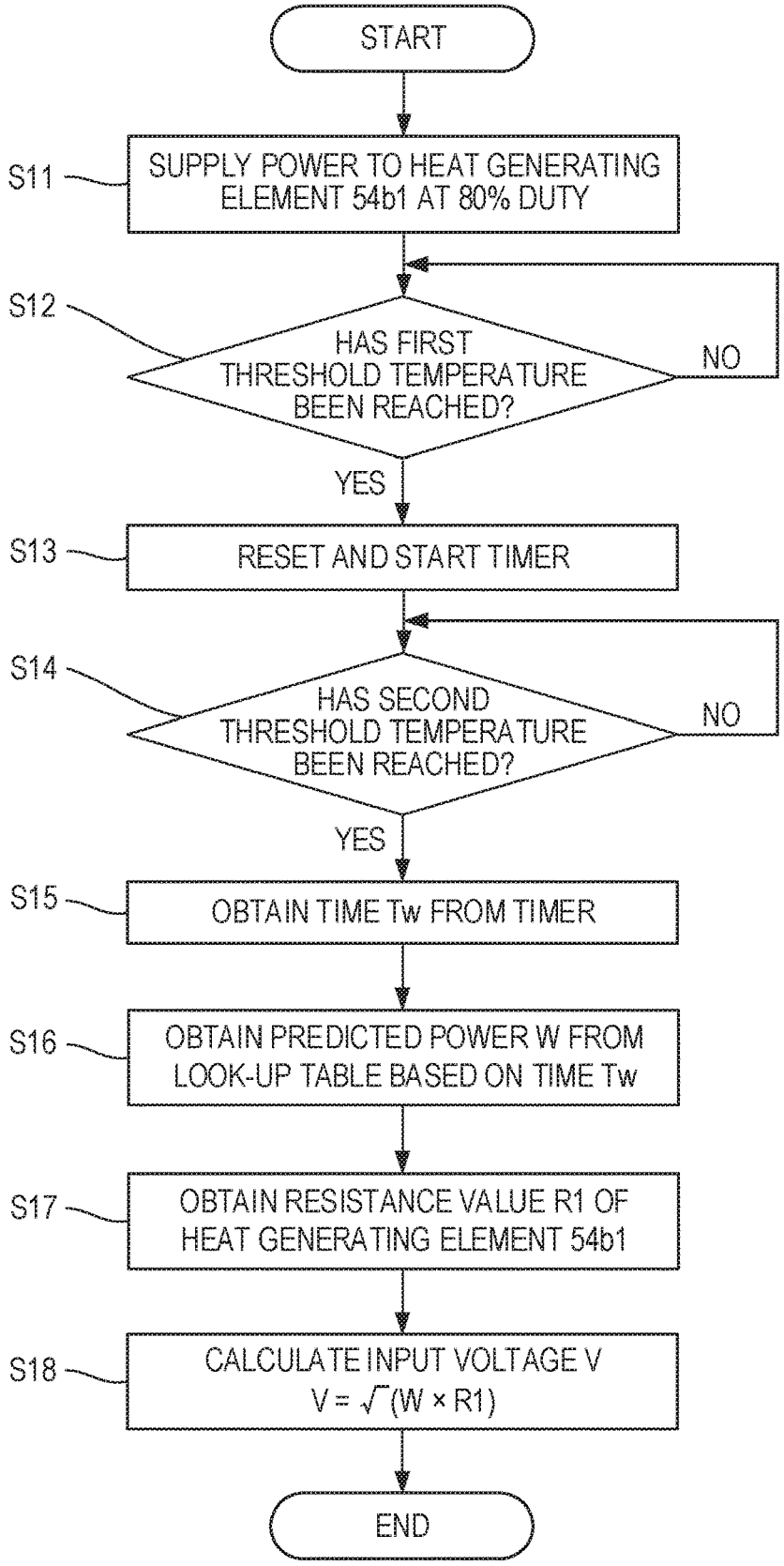
FIG. 7 is a flow chart of an input voltage prediction sequence in Embodiment 1.

In Embodiment 1, an input voltage from the AC power source 55 is obtained through use of an input voltage prediction sequence (voltage detection unit) described below. FIG. 7 is a flow chart for illustrating a control sequence for obtaining the input voltage from the AC power source 55. The processing illustrated in FIG. 7 is started when the image forming apparatus 170 is powered on, and is executed by the CPU 94. The memory 95 stores a resistance value R1 of the heat generating elements 54*b*1 measured in advance. The memory 95 also stores a look-up table obtained by converting a graph of FIG. 8 described later into a table.

When the image forming apparatus 170 is powered on, power is supplied from the AC power source 55 to the fixing apparatus 50 to perform an operation for rotating each roller in the apparatus (hereinafter referred to as "pre-multi rotation"). In Step S11, the CPU 94 controls the TRIACs 56*a* and 56*b* and the switcher 57 to supply power from the AC power source 55 to the heat generating elements 54*b*1 at 80% duty during the pre-multi rotation. In Step S12, the CPU 94 determines whether or not the temperature of the fixing temperature sensor 59 has reached a first threshold temperature (=100° C.), which is a first temperature, after the power supply. The CPU 94 advances the processing to Step S13 when determining that the first threshold temperature has been reached, and returns the processing to Step S12 when determining that the first threshold temperature has not been reached.

In Step S13, the CPU 94 resets and starts the timer. In Step S14, the CPU 94 determines whether or not the temperature of the fixing temperature sensor 59 has reached a second threshold temperature (=150° C.), which is a second temperature. The CPU 94 advances the processing to Step S15 when determining that the second threshold temperature has been reached, and returns the processing to Step S14 when determining that the second threshold temperature has not been reached.

Figure 8:
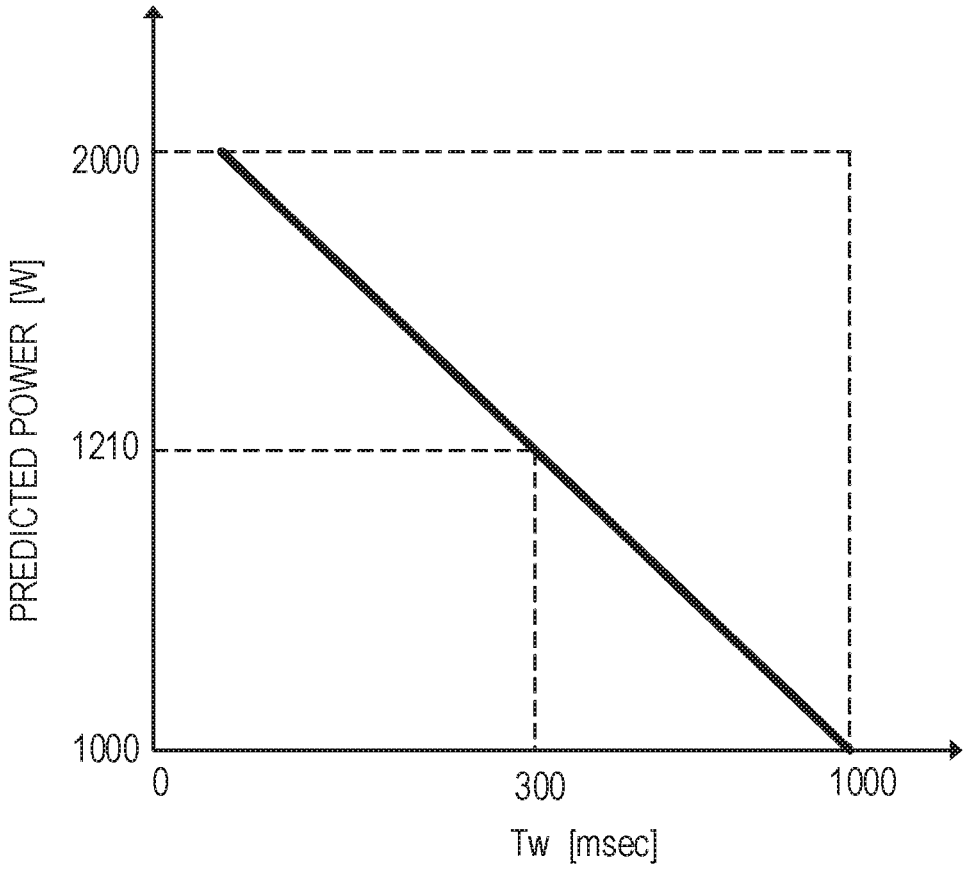
FIG. 8 is a graph for showing a relationship between a temperature rise time and a predicted power of a heat generating element in Embodiment 1.

In Step S15, the CPU 94 obtains, based on a timer value of the timer, a time Tw elapsed until the temperature of the fixing temperature sensor 59 reaches the second threshold temperature (=150° C.) from the first threshold temperature (=100° C.). In this case, FIG. 8 is a graph in which a relationship between the time Tw and a predicted power supplied to the heat generating elements is experimentally obtained. In FIG. 8, the horizontal axis represents a time (unit: millisecond (msec)) elapsed after the temperature of the fixing temperature sensor 59 reaches the first threshold temperature, and the vertical axis represents power (predicted power) of the heat generating elements (unit: W). In FIG. 8, for example, it is indicated that the predicted power is 1,210 W when the time Tw is 300 msec, and that the predicted power is 1,000 W when the time Tw is 1,000 msec. The memory 95 stores a look-up table for calculating the predicted power of the heat generating elements from the measured time Tw based on the graph of FIG. 8. In Step S16, the CPU 94 obtains a predicted power W of the heat generating elements 54*b*1 corresponding to the obtained time Tw from the look-up table stored in the memory 95.

In Step S17, the CPU 94 obtains the resistance value R1 of the heat generating elements 54*b* from the memory 95. In Step S18, the CPU 94 calculates the input voltage from the AC power source 55 through use of the predicted power W of the heat generating elements 54*b*1 obtained in Step S16 and the resistance value R1 of the heat generating elements 54*b*1 obtained in Step S7. It is assumed that the CPU 94 calculates an input voltage V from the AC power source 55 based on the expression of "(input voltage V)=√((predicted power W)×(resistance value R1))". The CPU 94 stores the calculated input voltage from the AC power source 55 in the memory 95 to bring the processing to an end.

In this manner, when the input voltage V from the AC power source 55 is to be obtained, it is not essential to measure the input voltage V, and a predicted value may be obtained as in Embodiment 1, or an index having a strong correlation with the input voltage V may be used. The above-mentioned processing of from Step S11 to Step S18 for calculating the input voltage is executed not only when the image forming apparatus 170 is powered on but also during the pre-multi rotation performed when the CPU 94 starts an image forming operation after receiving a print command.

[Temperature Prediction of Fixing Apparatus]

Next, a count temperature prediction method of predicting the temperature of the heater 54 of the fixing apparatus 50 is described. In Embodiment 1, a count value is used in order to predict the temperature of each of the members (for example, the film 51, the pressure roller 53, and the nip forming member 52) that form the fixing apparatus 50. The count value is stored in the CPU 94 or in the memory 95, and is incremented by +1 each time fixing processing is performed on one sheet P. Therefore, as the number of sheets P to be fixed becomes larger, the count value increases. Meanwhile, under a standby state after the fixing processing is completed, each member of the fixing apparatus 50 is naturally cooled, to thereby lower the temperature thereof. In accordance with this, the count value is also counted down with a lapse of time. Specifically, a cooling characteristic of each member of the fixing apparatus 50 is examined in advance, and the count value is subtracted through use of an operational expression with the elapsed time as a parameter. A method of thus predicting the temperature of each member of the fixing apparatus 50 based on the count value is called "count temperature prediction method".

[Required Power in Each Zone]

For example, a section from a state in which the count value is 0 to a first target count value is called "Zone 1", and a section from the first target count value to a second target count value is called "Zone 2". The switching timing of power supply to the heat generating elements 54*b* is changed depending on each zone. The number of zones is not limited to two, and a plurality of zones may be provided. In Embodiment 1, the first target count value is set to 30, the second target count value is set to 100, and a third target count value is set to 200, to thereby provide four zones. For example, after the fixing apparatus 50 starts printing on the sheet P from the cold state (state in which the count is 0), the count value reaches the first target count value of 30 when 30 sheets P are printed (that is, when the fixing processing of 30 sheets P is completed). Therefore, Zone 1 ends when the printing on the 30th sheet P ends, and is switched to Zone 2 when the printing on the 31st sheet P is started.

A heat generation amount required for the heat generating elements 54*b*1, 54*b*2, and 54*b*3 to melt the toner forming the toner image on the sheet P and fix the toner to the sheet P varies depending on an amount of heat stored in the heater 54 of the fixing apparatus 50. A large heat generation amount is required when the heater 54 of the fixing apparatus 50 is cold, but the required heat generation amount is small when the heater 54 of the fixing apparatus 50 has been warmed, for example, after continuous printing is performed.

Table 1 is a table for showing a required power of the heater 54 per unit length in each of the above-mentioned zones. In Table 1, the left column indicates the zones (Zones 1 to 4), and the right column shows the required power of the heater 54 per unit length (unit: W/meter (W/m)) corresponding to each zone. The required powers shown in Table 1 were confirmed by experimentally changing the power in each zone and evaluating the fixability of the toner with respect to the sheet P. The values of the required powers shown in Table 1 are each described by being rounded off to the first place.

TABLE 1

| Zone | Required power per unit length (W/m) |
|---|---|
| 1 | 4,440 |
| 2 | 3,920 |
| 3 | 3,420 |
| 4 | 3,020 |

[Relationship Between Input Voltage from AC Power Source and Power Ratio Among Heat Generating Elements]

As described above, in Embodiment 1, the maximum heat generation amount of the heat generating elements 54b1 having the largest length in the longitudinal direction is the largest. Therefore, when the heater 54 of the fixing apparatus 50 is in a cold state, a wait time (waiting time) elapsed until the heater 54 reaches the target temperature can be minimized by supplying the maximum power to the heat generating elements 54b. When the heater 54 of the fixing apparatus 50 has been warmed, there occurs a phenomenon called "non-sheet-passing portion temperature rise", in which the temperature of the heater 54 of the fixing apparatus 50 gradually rises in an end portion area (non-sheet-passing portion area) of the heat generating elements 54b1 in the longitudinal direction, through which the sheet P does not pass. In Embodiment 1, the non-sheet-passing portion temperature rise is alleviated through use of the heat generating elements (for example, the heat generating element 54b2 and the heat generating element 54b3) having the length in the longitudinal direction corresponding to the size of the sheet P to be used. However, as described above, the heat generating elements 54b2 and 54b3 each have the maximum power set to a small value, and therefore cannot separately achieve the power required in each zone. Therefore, in Embodiment 1, the shortage of the required power is compensated through use of the heat generating elements 54b1 in an auxiliary manner. As the heater 54 of the fixing apparatus 50 becomes warmer, the required power becomes smaller. Therefore, the power ratio for supplying power to the heat generating elements 54b1 can also be reduced. As a result, in a state in which the non-sheet-passing portion temperature rise is conspicuous, the power ratio of the heat generating elements 54b1 decreases, and the power ratio of the heat generating elements 54b2 and 54b3 having low power increases. Therefore, the temperature of the heat generating elements decreases, and as a result, it is possible to produce an effect of sufficiently alleviating the non-sheet-passing portion temperature rise.

(Power Ratio Exhibited when the Input Voltage is 110 V)

Specifically, a case in which the continuous printing is performed on the A5-size sheets P with an input voltage of 110 V is described below. The image forming apparatus 170 according to Embodiment 1 is capable of printing the A5-size sheets P at a speed of 30 sheets per minute. When the A5-size sheet P is to be printed, the fixing apparatus 50 performs a fixing operation through use of the heat generating elements 54b1 and 54b3. When the input voltage is 110 V, the maximum power of the heat generating elements 54b is 5,450 W/m, and the maximum power of the heat generating element 54b3 is 2,619 W/m.

Table 2 shown below is a table for showing, for each zone, the required power (unit: W/m), the power ratio exhibited when one cycle of a power supply period is set as 10, the maximum power for a sheet passing area (unit: W/m), and the fixability indicating the presence or absence of an occurrence of poor fixing. The fields "54b1" and "54b3" in the power ratio of Table 2 correspond to the heat generating elements 54b and 54b3, respectively. The maximum power for the sheet passing area in each zone can be obtained by Expression 1.

(Maximum power for sheet passing area)=(maximum power of heat generating element 54b1)×(power ratio of heat generating element 54b1)+(maximum power of heat generating element 54b3)×(power ratio of heat generating element 54b3) Expression 1

When the maximum power for the sheet passing area in each zone is obtained through use of Expression 1, the following results are obtained. With reference to Table 2, the power ratio between the heat generating elements 54b and 54b3 in Zone 1 is 7:3. Therefore, in accordance with Expression 1, (maximum power for sheet passing area)=(5,450 W/m)×(7/10)+(2,619 W/m)×(3/10)=3,815+785.7=4,600.7≈4,600 (W/m) (rounded off to the first place). In addition, with reference to Table 2, the power ratio between the heat generating elements 54b1 and 54b3 in Zone 2 is 5:5. Therefore, in accordance with Expression 1, (maximum power for sheet passing area)=(5,450 W/m)×(5/10)+(2,619 W/m)×(5/10)=2,725+1,309.5=4,034.5≈4,030 (W/m) (rounded off to the first place). Further, with reference to Table 2, the power ratio between the heat generating elements 54b1 and 54b3 in Zone 3 is 3:7. Therefore, in accordance with Expression 1, (maximum power for sheet passing area)=(5,450 W/m)×(3/10)+(2,619 W/m)×(7/10)=1,635+1,833.3=3,468.3≈3,470 (W/m)(rounded off to the first place). Still further, with reference to Table 2, the power ratio between the heat generating elements 54b1 and 54b3 in Zone 4 is 2:8. Therefore, in accordance with Expression 1, (maximum power for sheet passing area)=(5,450 W/m)×(2/10)+(2,619 W/m)×(8/10)=1,090+2,095.2=3,185.2≈3,190 (W/m) (rounded off to the first place).

In regard to the maximum power for the sheet passing area in each zone shown in Table 2, a relationship of (required power)<(maximum power for sheet passing area) is established with respect to the required power in each zone. Therefore, the use of the power ratios shown in Table 2 did not cause the poor fixing in each zone due to the shortage of required power. The presence or absence of the occurrence of the poor fixing is indicated in a "fixability" field of the table.

TABLE 2

| Zone | Required power (W/m) | Power ratio 54b1 | Power ratio 54b3 | Maximum power for sheet passing area (W/m) | Fixability |
|---|---|---|---|---|---|
| 1 | 4,440 | 7 | 3 | 4,600 | No issue |
| 2 | 3,920 | 5 | 5 | 4,030 | No issue |
| 3 | 3,420 | 3 | 7 | 3,470 | No issue |
| 4 | 3,020 | 2 | 8 | 3,190 | No issue |

(Control Sequence for Image Formation)

Figure 9:
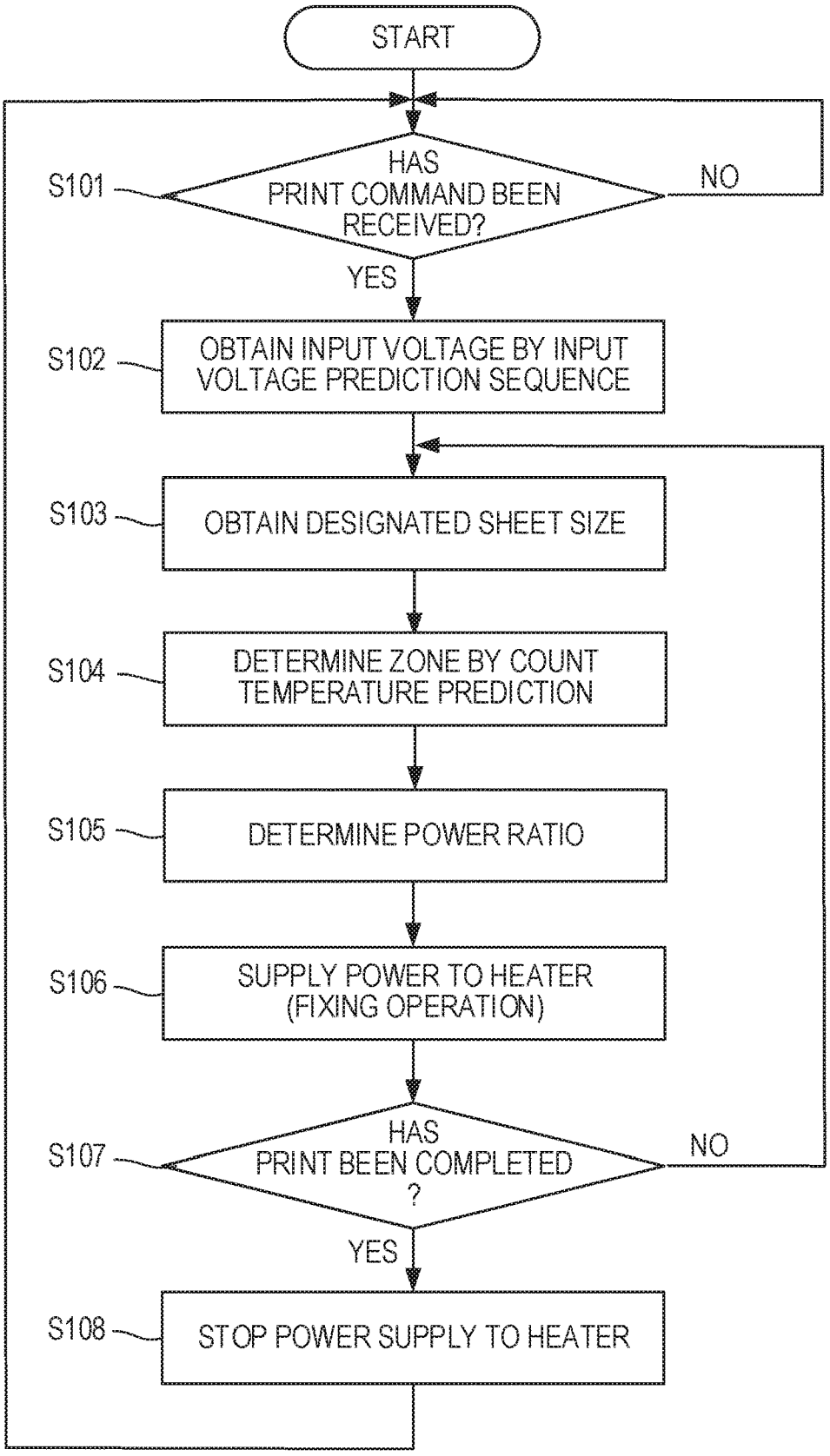
FIG. 9 is a flow chart for illustrating a control sequence of the fixing apparatus according to each of Embodiments 1 and 2.

FIG. 9 is a flow chart for illustrating a control sequence to be performed by the image forming apparatus 170 after receiving a print command from the PC 110 being a host computer until the printing on the sheet P is finished. The processing illustrated in FIG. 9 is started when the image forming apparatus 170 is powered on, and is executed by the CPU 94.

In Step S101, the CPU 94 determines whether or not a print command has been received from the PC 110. When determining that a print command has been received, the CPU 94 advances the processing to Step S102, and when determining that a print command has not been received, returns the processing to Step S101. In Step S102, the CPU 94 obtains the input voltage from the AC power source 55 through use of the above-mentioned input voltage prediction sequence. In Step S103, the CPU 94 obtains the size of the sheet P (designated sheet size) designated by the received print command. In Step S104, the CPU 94 determines the zone for performing printing on the sheet P by the above-mentioned count temperature prediction. In Step S105, the CPU 94 determines the power ratio between the heat generating elements 54*b* to be used when printing is performed on the current sheet P through use of the size of the sheet P obtained in Step S103, the zone determined in Step S104, and the input voltage obtained in Step S102. In Step S106, the CPU 94 controls the target temperature of the heater 54 by supplying power to the heat generating elements 54*b* of the heater 54 based on the power ratio determined in Step S105, and performs the fixing operation on the conveyed sheet P. In Step S107, the CPU 94 determines whether or not the printing based on the print command has been completed. When determining that the printing has been completed, the CPU 94 advances the processing to Step S108, and when determining that the printing has not been completed, returns the processing to Step S102. In Step S108, the CPU 94 stops the power supply to the heat generating elements 54*b* of the heater 54 of the fixing apparatus 50, and returns the processing to Step S103.

Now, a state of the heater 54 of the fixing apparatus 50 exhibited when the input voltage decreases is described. Table 3 is a table obtained by listing, for each zone, the maximum power for the sheet passing area and the fixability, which are exhibited when the power is supplied to the heat generating elements 54*b*1 and 54*b*3 at the same power ratio as in Table 2 in an exemplary case where the input voltage has decreased from 110 V to 100 V. A manner of reading Table 3 is the same as that of Table 2 described above, and description thereof is omitted here. The maximum power for the sheet passing area shown in Table 3 is obtained by substituting the maximum powers of the heat generating elements 54*b*1 and 54*b*3 exhibited when the input voltage is 100 V and the power ratio shown in Table 3 into Expression 1. The maximum power exhibited when the input voltage is 100 V can be calculated based on "(maximum power P)=(input voltage)$^2$/(resistance value)" and the maximum power exhibited when the input voltage is 110 V. The thus obtained maximum powers of the heat generating elements 54*b*1 and the heat generating elements 54*b*3, which are exhibited when the input voltage is 100 V, are 4,505 W/m and 2,165 W/m, respectively.

The maximum power for the sheet passing area in each zone is obtained with reference to Table 3. With reference to Table 3, the power ratio between the heat generating elements 54*b*1 and 54*b*3 in Zone 1 is 7:3. Therefore, in accordance with Expression 1, (maximum power for sheet passing area)=(4,505 W/m)×(7/10)+(2,165 W/m)×(3/10)=3,153.5+649.5=3,803≈3,800 (W/m) (rounded off to the first place). In addition, with reference to Table 3, the power ratio between the heat generating elements 54*b*1 and 54*b*3 in Zone 2 is 5:5. Therefore, in accordance with Expression 1, (maximum power for sheet passing area)=(4,505 W/m)×(5/10)+(2,165 W/m)×(5/10)=2,252.5+1,082.5=3,335≈3,340 (W/m) (rounded off to the first place). Further, with reference to Table 3, the power ratio between the heat generating elements 54*b*1 and 54*b*3 in Zone 3 is 3:7. Therefore, in accordance with Expression 1, (maximum power for sheet passing area)=(4,505 W/m)×(3/10)+(2,165 W/m)×(7/10)=1,351.5+1,515.5=2,867≈2,870 (W/m)(rounded off to the first place). Still further, with reference to Table 3, the power ratio between the heat generating elements 54*b*1 and 54*b*3 in Zone 4 is 2:8. Therefore, in accordance with Expression 1, (maximum power for sheet passing area)=(4,505 W/m)×(2/10)+(2,165 W/m)×(8/10)=901+1,732=2,633≈2,630 (W/m) (rounded off to the first place).

The maximum power for the sheet passing area in each zone shown in Table 3 has a relationship of "(required power)>(maximum power for sheet passing area)" with respect to the required power in each zone. Therefore, in the case where the input voltage is 100 V and the power ratio exhibited when the input voltage is 110 V is employed, the required power becomes insufficient, to thereby cause, as indicated in the "fixability" field of Table 3, the poor fixing in which the toner of the toner image is not completely melted due to the power shortage. Then, when the printing operation on the sheet P is continued under a state in which the poor fixing has occurred, there occurs printing failure in which, for example, the toner adheres to a fixing member of the fixing apparatus 50 to cause the adhered toner to be discharged (to adhere) to the succeeding sheet P.

TABLE 3

| Zone | Required power (W/m) | Power ratio 54b1 | Power ratio 54b3 | Maximum power for sheet passing area (W/m) | Fixability |
|---|---|---|---|---|---|
| 1 | 4,440 | 7 | 3 | 3,800 | Poor fixing has occurred |
| 2 | 3,920 | 5 | 5 | 3,340 | Poor fixing has occurred |
| 3 | 3,420 | 3 | 7 | 2,870 | Poor fixing has occurred |
| 4 | 3,020 | 2 | 8 | 2,630 | Poor fixing has occurred |

(Power Ratio Exhibited when Input Voltage is 100 V)

In view of the foregoing, in Embodiment 1, when the input voltage is 100 V, a power ratio different from that exhibited when the input voltage is 110 V is employed. Table 4 is a table for showing the power ratio, the maximum power for the sheet passing area, and the fixability, which are exhibited when the input voltage is 100 V A manner of reading Table 4 is the same as those of Tables 2 and 3 described above, and description thereof is omitted here.

The maximum power for the sheet passing area in each zone is obtained with reference to Expression 4. With reference to Table 4, the power ratio between the heat generating elements 54*b*1 and 54*b*3 in Zone 1 is 10:0. Therefore, in accordance with Expression 1, (maximum power for sheet passing area)=(4,505 W/m)×(10/10)+(2,165 W/m)×(0/10)=4,505≈4,510 (W/m) (rounded off to the first place). In addition, with reference to Table 4, the power ratio between the heat generating elements 54*b*1 and 54*b*3 in Zone 2 is 8:2. Therefore, in accordance with Expression 1, (maximum power for sheet passing area)=(4,505 W/m)×(8/10+(2,165 W/m)×(2/10)=3,604+433=4,037≈4,040 (W/m) (rounded off to the first place). Further, with reference to Table 4, the power ratio between the heat generating elements 54*b*1 and 54*b*3 in Zone 3 is 6:4. Therefore, in accordance with Expression 1, (maximum power for sheet passing area)=(4,505 W/m)×(6/10)+(2,165 W/m)×(4/10)=2,703+866=3,569≈3,570 (W/m) (rounded off to the first place). Still further, with reference to Table 4, the power ratio between the heat generating elements 54*b*1 and 54*b*3 in Zone 4 is 4:6. Therefore, in accordance with Expression 1, (maximum power for sheet passing area)=(4,505 W/m)×(4/10)+(2,165 W/m)×(6/10)=1,802+1,299=3,101≈3,100 (W/m) (rounded off to the first place).

In regard to the maximum power for the sheet passing area in each zone shown in Table 4, a relationship of "(required power)<(maximum power for sheet passing area)" is established with respect to the required power in each zone. Therefore, the use of the power ratios shown in Table 4 does not cause the poor fixing due to the shortage of required power in all zones. The presence or absence of the occurrence of the poor fixing is indicated in a "fixability" field of the table.

TABLE 4

| Zone | Required power (W/m) | Power ratio 54b1 | Power ratio 54b3 | Maximum power for sheet passing area (W/m) | Fixability |
|---|---|---|---|---|---|
| 1 | 4,440 | 10 | 0 | 4,510 | No issue |
| 2 | 3,920 | 8 | 2 | 4,040 | No issue |
| 3 | 3,420 | 6 | 4 | 3,570 | No issue |
| 4 | 3,020 | 4 | 6 | 3,100 | No issue |

[Power Ratio Corresponding to Input Voltage]

Table 5 is a table obtained by listing the power ratios corresponding to specific input voltages. In Table 5, the power ratio for each zone is changed depending on whether the input voltage is 110 V or higher or is lower than 110 V. As the power ratios in Table 5, the power ratios shown in Table 2 are set when the input voltage is 110 V or higher, and the power ratios shown in Table 4 are set when the input voltage is lower than 110 V When the zone corresponding to the number of printed sheets P and the power ratio shown in Table 5 corresponding to the result of the input voltage prediction sequence were employed at the time of executing the printing on the sheet P, the heater 54 of the fixing apparatus caused no poor fixing due to the power shortage in all cases.

TABLE 5

| | Input voltage detection result | | | |
|---|---|---|---|---|
| | Lower than 110 V | | 110 V or higher | |
| Zone | 54b1 Power ratio | 54b3 Power ratio | 54b1 Power ratio | 54b3 Power ratio |
| 1 | 10 | 0 | 7 | 3 |
| 2 | 8 | 2 | 5 | 5 |
| 3 | 6 | 4 | 3 | 7 |
| 4 | 4 | 6 | 2 | 8 |

In this manner, in Embodiment 1, when it is determined that the input voltage has decreased, the power ratio of the heat generating element having a longer length in the longitudinal direction among the plurality of heat generating elements arranged in the heater 54 is increased. Now, a method of experimentally confirming the above-mentioned power ratio is described. First, in order to measure a current flowing through each heat generating element of the heater 54, ammeters are arranged between the TRIAC 56*a* and the heat generating elements 54*b*1 and between the TRIAC 56*b* and the heat generating elements 54*b*2 and 54*b*3. Then, in order to stabilize the amount of heat of the heater 54 of the fixing apparatus 50, intermittent times are unified to perform the continuous printing on the sheets P a plurality of times. For example, in Embodiment 1, when 20 sheets are set as one set and a time between sets is set to 3 minutes, the temperature of the pressure roller before the start of printing was stable at about 90° C. The zone based on the count value at that time was Zone 4. A current value is measured under such a stable state, and the power W supplied to each heat generating element 54*b* is obtained based on the previously-measured resistance value of each heat generating element 54*b* of the heater 54. As the measured current value, an average value of current values measured for a plurality of sheets P is used. As a result of performing the above-mentioned work while changing the input voltage, in Embodiment 1, the power ratio obtained in an actual experiment is 2.1:7.9 compared to the power ratio of 2:8 in Zone 4 in the case of 100 V, and hence the power ratio shown in Table 2 was successfully achieved on the whole.

As described above, in Embodiment 1, the power ratio among the heat generating elements 54*b* to be employed by the heater 54 is determined based on the input voltage obtained by the input voltage prediction sequence. Specifically, when it is determined that the input voltage has decreased, the power ratio of the heat generating element having a longer length in the longitudinal direction among the plurality of heat generating elements is increased. It was possible to suppress, by performing such control, a change in temperature distribution of the heat generating elements in the longitudinal direction due to a change in input voltage, to thereby successfully suppress the poor fixing due to the temperature decrease. The description of Embodiment 1 is directed to the case in which the heat generating element 54*b*3 corresponding to the A5-size sheet P is used. Even in a case where the heat generating element 54*b*2 corresponding to the B5-size sheet P is used during, for example, B5 continuous printing, it is possible to produce the same effect by changing the power ratio when the input voltage is low.

As described above, according to Embodiment 1, it is possible to switch the power supply to the heat generating elements depending on the change in input voltage.

Embodiment 2

In Embodiment 1, the changing of the power ratio for controlling the power supply to the heat generating elements of the heater when the input voltage from the AC power source, which is obtained by the input voltage prediction sequence, has decreased is described. In Embodiment 2, there is described changing of the power ratio for controlling the power supply to the heat generating elements of the heater when the input voltage from the AC power source, which is obtained by a method different from that of Embodiment 1, has increased. A configuration of an image forming apparatus 270 to which Embodiment 2 is applied is the same as that of the image forming apparatus 170 described in FIG. 1 of Embodiment 1, and the same devices are denoted by the same reference symbols, to thereby omit description thereof.

[Control Block Diagram of Image Forming Apparatus]

Figure 10:
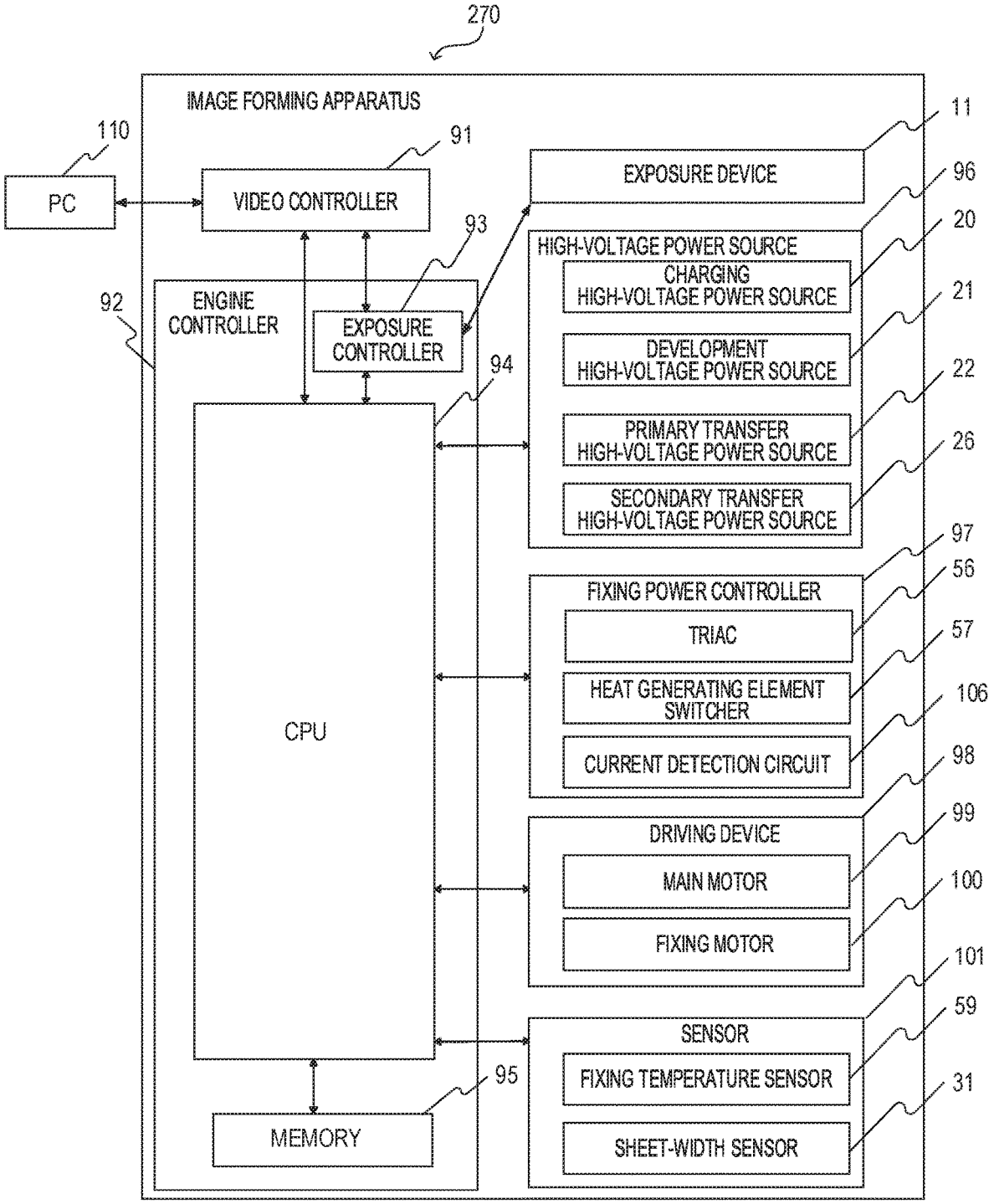
FIG. 10 is a control block diagram of the image forming apparatus according to Embodiment 2.

FIG. 10 is a block diagram for illustrating the configuration of a control section of the image forming apparatus 270 according to Embodiment 2. FIG. 10 is different from FIG. 2 of Embodiment 1 in that a current detection circuit 106 configured to detect a current flowing from the AC power source 55 to the fixing apparatus 50 is added to the fixing power controller 97. In FIG. 10, the other components are the same as those of Embodiment 1 illustrated in FIG. 2, and description thereof is omitted here.

[Configuration of Power Control Circuit]

Figure 11:
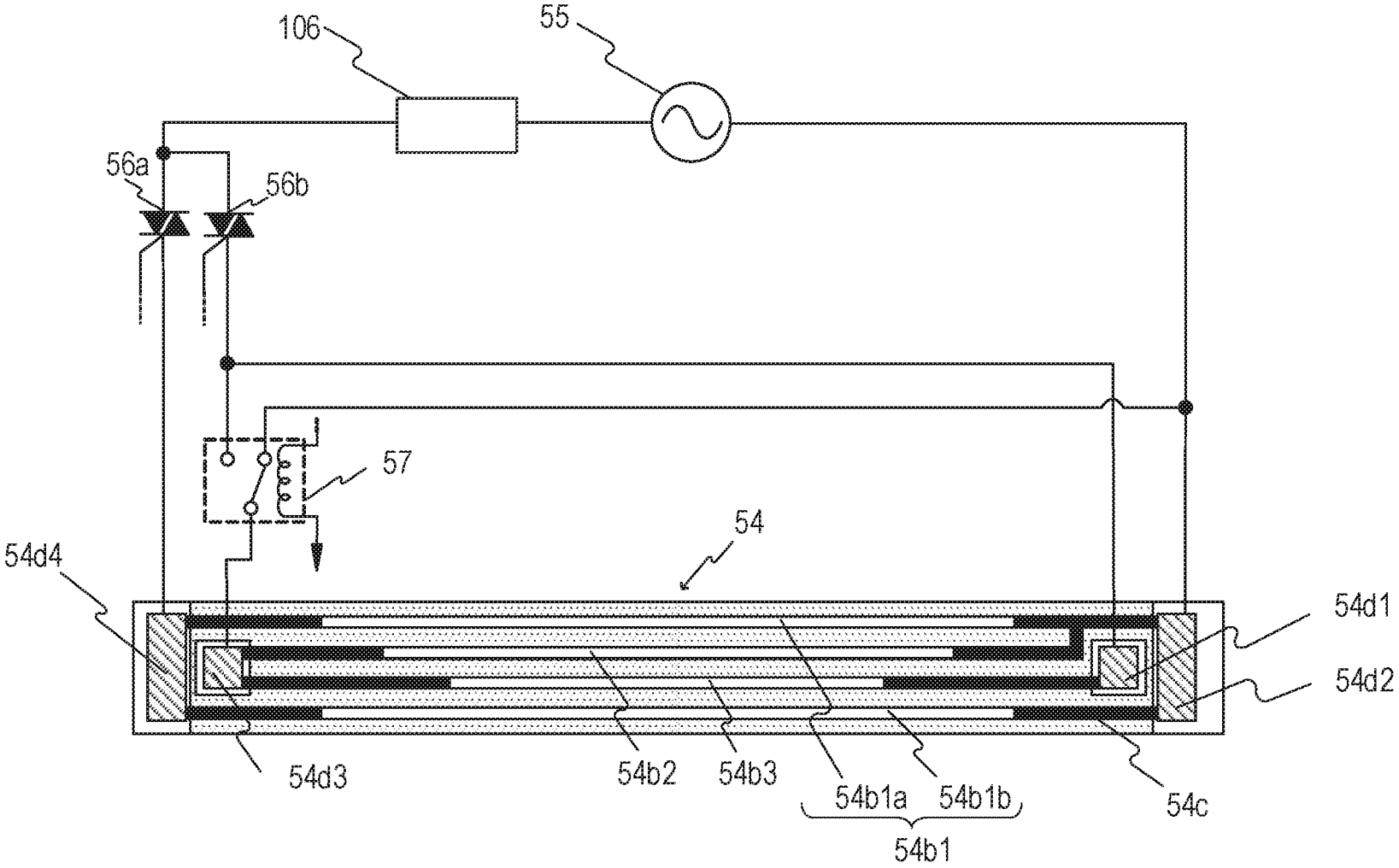
FIG. 11 is a schematic view of a power control circuit of the fixing apparatus according to Embodiment 2.

FIG. 11 is a schematic view for illustrating a configuration of the power control circuit of the fixing apparatus 50 according to Embodiment 2. FIG. 11 is different from FIG. 6 of Embodiment 1 in that the current detection circuit 106 is provided on a power supply route between the AC power source 55 and the TRIACs 56*a* and 56*b*. The current detection circuit 106 being a current detection unit is configured to detect the current flowing from the AC power source 55 to the fixing apparatus 50 to notify the CPU 94 of a result of the detection. The CPU 94 uses an input voltage calculation sequence, which is described later, to calculate the input voltage from the AC power source 55 based on a current value detected by the current detection circuit 106. The other circuit components of the power control circuit illustrated in FIG. 11 is the same as the circuit components illustrated in FIG. 6 of Embodiment 1, and the description thereof is omitted here.

[Calculation of Input Voltage of AC Power Source]

Figure 12:
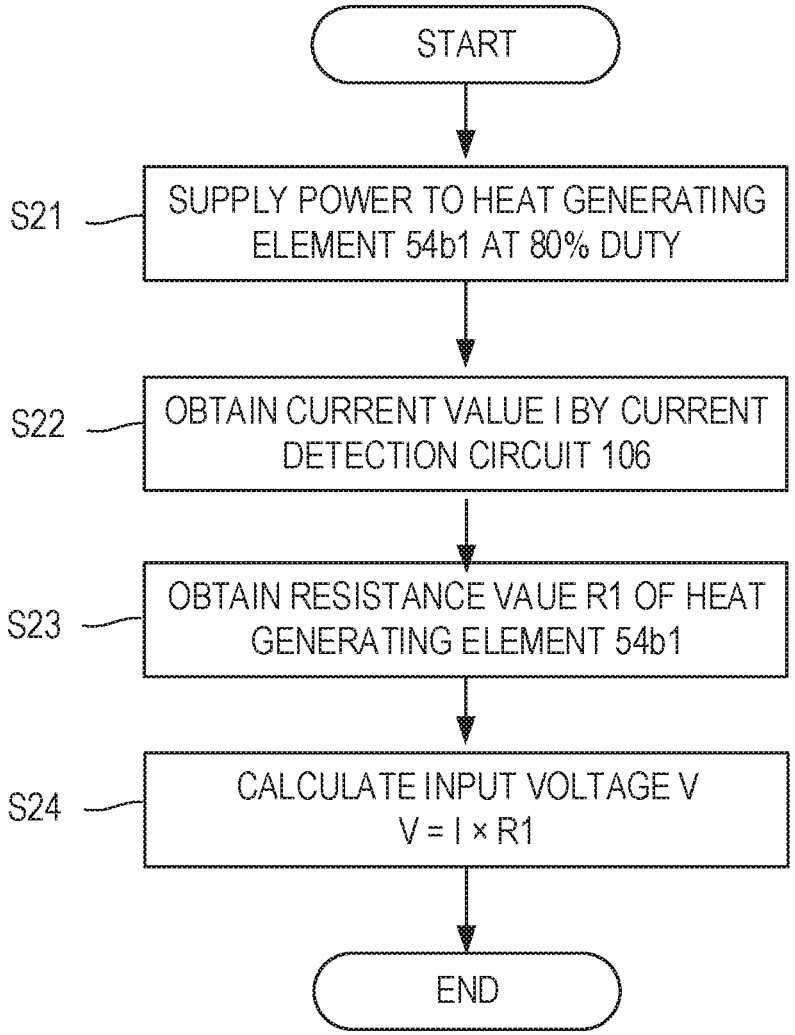
FIG. 12 is a flow chart of an input voltage calculation sequence in Embodiment 2.

In Embodiment 2, an input voltage from the AC power source 55 is obtained through use of an input voltage calculation sequence (voltage detection unit) described below. FIG. 12 is a flow chart for illustrating a control sequence for predicting the input voltage from the AC power source 55. The processing illustrated in FIG. 12 is started when the image forming apparatus 270 is powered on, and is executed by the CPU 94. The memory 95 stores the resistance value R1 of the heat generating elements 54*b*1 measured in advance.

When the image forming apparatus 270 is powered on, power is supplied from the AC power source 55 to the fixing apparatus 50 to perform the pre-multi rotation for rotating each roller in the apparatus. In Step S21, the CPU 94 controls the TRIACs 56*a* and 56*b* and the switcher 57 to supply power from the AC power source 55 to the heat generating elements 54*b*1 at 800% duty during the pre-multi rotation. In Step S22, the CPU 94 causes the current detection circuit 106 to obtain a current value I supplied from the AC power source 55 to the heat generating elements 54*b*1. In Step S23, the CPU 94 obtains the resistance value R1 of the heat generating elements 54*b*1 from the memory 95. In Step S24, the CPU 94 calculates the input voltage V from the AC power source 55 through use of the current value I obtained in Step S22 and the resistance value R1 of the heat generating elements 54*b*1 obtained in Step S23, and stores the calculated input voltage V from the AC power source 55 in the memory 95, to thereby bring the processing to an end. The CPU 94 calculates the input voltage V from the AC power source 55 by "(input voltage V)=(current value I)×(resistance value R1)". In this manner, in Embodiment 2, the input voltage V from the AC power source 55 is calculated based on the actually-measured current value I and the resistance value R1 of the heat generating elements. Therefore, it is possible to calculate the input voltage to the heat generating elements 54*b* of the heater 54 more accurately than by the above-mentioned input voltage prediction sequence in Embodiment 1. In addition, the above-mentioned processing of from Step S21 to Step S24 for calculating the input voltage described above is performed not only when the image forming apparatus 270 is powered on but also during the pre-multi rotation when the CPU 94 starts an image forming operation after receiving a print command.

[Temperature Distribution of Heat Generating Elements During Continuous Printing]

In Embodiment 2, an operation during continuous printing of an invoice sheet (having a sheet width of 139.7 mm in the longitudinal direction) is described. In the case of printing the invoice sheet, a printing speed is set so that 30 sheets P can be printed per minute as in the case of printing the A5-size sheet P. The number of printed sheets P per minute is hereinafter referred to as "print per minute (PPM)". The PPM also serves as an index indicating the productivity of the image forming apparatus 270.

Figures 13A, 13B, 13C:
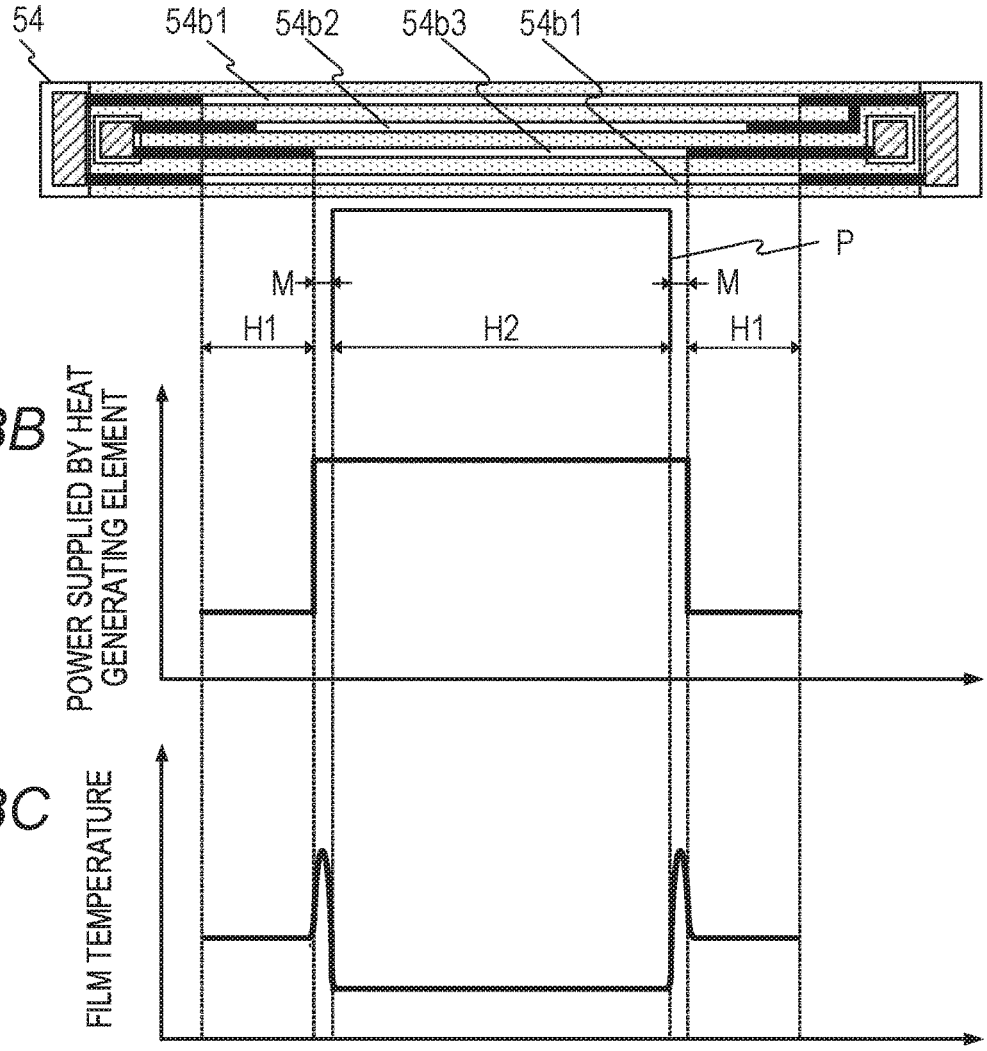
FIG. 13A, FIG. 13B, and FIG. 13C are diagrams for showing a positional relationship between the heater in Embodiment 2 and a film temperature in the longitudinal direction.

FIG. 13A, FIG. 13B, and FIG. 13C are diagrams for illustrating the temperature distribution of the heater 54 of the fixing apparatus 50 exhibited when printing is performed on the invoice sheet. FIG. 13A is a diagram for illustrating a positional relationship between the configuration of the heat generating elements 54*b*1, 54*b*2, and 54*b*3 of the heater 54 and the invoice sheet. For example, the heat generating elements 54*b* are mainly used when the sheet P to be used is an A4-size sheet, the heat generating element 54*b*2 is mainly used when the sheet P to be used is a B5-size sheet, and the heat generating element 54*b*3 is mainly used when the sheet P to be used is an A5-size sheet. In FIG. 13A, Range H1 indicates a range in which the temperature rises when the power is supplied to the heat generating elements 54*b*1 and does not rise due to no power being supplied when the power is supplied to the heat generating element 54*b*3. Range H2 indicates a length (sheet width) of the invoice sheet in the longitudinal direction in FIG. 13A. Range M between Range H1 and Range H2 indicates a range within the length of the heat generating element 54*b*3 in the longitudinal direction, through which the invoice sheet does not pass.

In FIG. 13B, the electric energy supplied to the film 51 by the heat generating elements 54*b* of the heater 54 is illustrated, the horizontal axis represents a position with respect to the film 51, and the vertical axis represents the electric energy supplied by the heat generating elements 54*b*1 and 54*b*3. In FIG. 13C, a conceptual image of the film temperature of the film 51 to which the electric energy illustrated in FIG. 13B is supplied is illustrated, the horizontal axis represents a position with respect to the heater 54, and the vertical axis represents a surface temperature of the film 51. The conceptual image of the film temperature indicates a temperature exhibited when the invoice sheet has passed through the fixing nip portion N of the fixing apparatus 50 illustrated in FIG. 3.

Even in the case of the invoice sheet, the image forming apparatus 270 controls the power ratio between the heat generating elements 54*b*1 and the heat generating element 54*b*3 to perform printing as in the case of the A5-size sheet P. However, the invoice sheet has a width narrower in the longitudinal direction than that of the A5-size sheet P, and as illustrated in FIG. 13A, falls within a range of the length of the heat generating element 54*b*3 in the longitudinal direction, and a proportion of Range M through which the invoice sheet does not pass becomes larger. As illustrated in FIG. 13C, a range of the heater 54 in the longitudinal direction in which the temperature of the film 51 becomes the maximum temperature is present within Range M. This is because the maximum power is supplied to Range M from the heat generating elements, and the film 51 is not deprived of heat by the invoice sheet due to the invoice sheet not passing through Range M.

In general, when the PPMs are the same, the film 51 is deprived of less heat by the sheet P as the width of the printed sheet P becomes shorter than the width (length in the longitudinal direction) of the heat generating elements 54*b* (54*b*1, 54*b*2, and 54*b*3). Therefore, the temperature of a member rises in an area of the heater 54 in the longitudinal direction through which the sheet P does not pass. As described above, even in Embodiment 2, the non-sheet-passing portion temperature rise becomes larger at the time of performing printing on the invoice sheet than at the time of performing printing on the A5-size sheet P. In addition, in general, as the PPM becomes larger, the non-sheet-passing portion temperature rise becomes larger.

[Setting of Power Ratio]

In view of the foregoing, in Embodiment 2, a power ratio "x" of the heat generating elements 54*b*1 of the heater 54 is set based on the following three conditions.

Condition 1: The value of "x" satisfies a conditional expression indicated by Expression 2.

$$\frac{V^2}{R1}\frac{1}{L1}x + \frac{V^2}{R3}\frac{1}{L3}(1-x) \geqq W \qquad \text{Expression 2}$$

Condition 2: The smallest value among values of "x" that satisfy Condition 1 is set.

Condition 3: Condition 1 and Condition 2 are satisfied, and x≥(1/10) is satisfied.

In this case, V indicated in Expression 2 is a value of the input voltage V obtained by the above-mentioned input voltage calculation sequence. In addition, the resistance value R1 is a resistance value of the heat generating elements 54*b*1, and a resistance value R3 is a resistance value of the heat generating element 54*b*3. It is assumed that the resistance value R1 and the resistance value R3 are each stored in the CPU 94 or in the memory 95. The length L1 is a length of the heat generating elements 54*b*1 in the longitudinal direction, and the length L3 is a length of the heat generating element 54*b*3 in the longitudinal direction. The power ratio "x" represents a power ratio of the heat generating elements 54*b*1. Therefore, the power ratio of the heat generating element 54*b*3 is (1−x). In addition, W represents a power per unit length required for the printing on the sheet P.

The left-hand side of Expression 2 represents the power supplied to a range in which the heat generating elements 54*b*1 and the heat generating element 54*b*3 overlap, which corresponds to Range H2 in FIG. 13A, by the heat generating elements 54*b*1 and 54*b*3. The first term on the left-hand side of Expression 2 represents the power supplied to the heat generating elements 54*b*1, and the second term represents the power supplied to the heat generating element 54*b*2. In Expression 2 indicated in Condition 1, when the power (on the left-hand side of Expression 2) supplied by the heat generating elements 54*b*1 and 54*b*3 is increased to be larger than W (on the right-hand side of Expression 2), it is possible to prevent the poor fixing due to the power shortage. Meanwhile, the power supplied to a range in which the heat generating elements 54*b*1 and the heat generating element 54*b*3 do not overlap, which corresponds to Range H1 in FIG. 13A, by the heat generating elements 54*b* is represented by the right-hand side of Expression 2 (that is, required power W). Therefore, when the smallest value among the values of the power ratio "x" satisfying the conditional expression of Expression 2 is set, the minimum required power is supplied to the heat generating elements 54*b* (Condition 2).

Now, there is described a case in which "(left-hand side)≥(right-hand side)" was established in Expression 2 even when the power ratio "x" of the heat generating elements 54*b*1 was set to 0. In this case, the power is not supplied to the heat generating elements 54*b*1, and hence it is indicated that the required power is sufficient only for the heat generating element 54*b*3 without the use of the heat generating elements 54*b*1. However, when the power ratio "x" of the heat generating elements 54*b*1 was set to 0, the temperature of the film 51 in Range H1 illustrated in FIG. 13A became extremely low in some cases. Therefore, grease applied to an inner surface of the film 51 in Range H1 was not completely melted, and as a result, there occurred a phenomenon in which a sliding load on the film 51 in Range H1 was increased, and the film 51 was deformed. In order to prevent the film 51 from being deformed, it is required to also supply power to the heat generating elements 54*b*1 to melt the grease in Range H1 as well. It was found through experiments that, in Range H1, the grease melts and the film 51 does not deform when a power of 200 W or higher is supplied. To satisfy this condition, it suffices that "x" is set to a value larger than 0, that is, x≥(1/10) in all the zones (Condition 3). In Embodiment 2, the power ratio is controlled so as to satisfy Condition 1 to Condition 3.

[Power Ratio in Case of Input Voltage of 127 V with 30 PPM]

Table 6 is a table obtained by listing the required power, the power ratio between the heat generating elements 54*b*1 and 54*b*3, the maximum power for the sheet passing area, a maximum power for an area outside the sheet passing area, an actual power for the sheet passing area, an actual power for the area outside the sheet passing area, and the maximum temperature of the film 51 in each zone, which are exhibited when the input voltage is 127 V (30 PPM).

TABLE 6

| Zone | Required power (W/m) | Power ratio 54b1 | Power ratio 54b3 | Maximum power for sheet passing area (W/m) | Maximum power for area outside sheet passing area (W/m) | Actual power for sheet passing area (W/m) | Actual power for area outside sheet passing area (W/m) | Film maximum termperature (° C.) |
|---|---|---|---|---|---|---|---|---|
| 1 | 4,440 | 3 | 7 | 4,620 | 2,180 | 4,470 | 2,120 | 225 |
| 2 | 3,920 | 2 | 8 | 4,250 | 1,450 | 3,960 | 1,360 | 224 |
| 3 | 3,420 | 1 | 9 | 3,870 | 730 | 3,460 | 650 | 223 |
| 4 | 3,020 | 1 | 9 | 3,870 | 730 | 3,100 | 580 | 220 |

The maximum power for the sheet passing area shown in Table 6 is obtained by substituting the maximum powers of the heat generating elements 54*b*1 and 54*b*3 exhibited when the input voltage is 127 V and the power ratio shown in Table 6 into Expression 1. The maximum power exhibited when the input voltage is 127 V can be calculated based on "(maximum power P)=(input voltage)$^2$/(resistance value)" and the maximum power exhibited when the input voltage is 120 V. The maximum powers of the heat generating elements 54*b*1 and the heat generating element 54*b*3, which are exhibited when the input voltage is 120 V, are 6,486 W/m and 3,117 W/m, respectively. The thus obtained maximum powers of the heat generating elements 54*b*1 and the maximum power of the heat generating element 54*b*3, which are exhibited when the input voltage is 127 V, are 7,265 W/m and 3,491 W/m, respectively.

The maximum power for the sheet passing area in each zone is obtained with reference to Expression 6. With reference to Table 6, the power ratio between the heat generating elements 54*b*1 and 54*b*3 in Zone 1 is 3:7. Therefore, in accordance with Expression 1, (maximum power for sheet passing area)=(7,265 W/m)×(3/10)+(3,491 W/m)×(7/10)=2,179.5+2443.7=4,623.2≈4,620 (W/m) (rounded off to the first place). In addition, with reference to Table 6, the power ratio between the heat generating elements 54*b*1 and 54*b*3 in Zone 2 is 2:8. Therefore, in accordance with Expression 1, (maximum power for sheet passing area)=(7,265 W/m)×(2/10)+(3,491 W/m)×(8/10)=1,453+2,792.8=4,245.8≈4,250 (W/m) (rounded off to the first place). Further, with reference to Table 6, the power ratio between the heat generating elements 54*b*1 and 54*b*3 in Zone 3 is 1:9. Therefore, in accordance with Expression 1, (maximum power for sheet passing area)=(7,265 W/m)×(1/10)+(3,491 W/m)×(9/10)=726.5+3,141.9=3,868.4≈3,870 (W/m)(rounded off to the first place). Still further, with reference to Table 6, the power ratio between the heat generating elements 54*b*1 and 54*b*3 in Zone 4 is 1:9. Therefore, in accordance with Expression 1, (maximum power for sheet passing area)=(7,265 W/m)×(1/10)+(3,491 W/m)×(9/10)=726.5+3,141.9=3,868.4≈3,870 (W/m) (rounded off to the first place).

Subsequently, with reference to Table 6, the maximum power for the area outside the sheet passing area is obtained. The maximum power for the area outside the sheet passing area in Table 6 is calculated by (maximum power of heat generating elements 54*b*1)×(power ratio of heat generating elements 54*b*1). Therefore, the maximum power for the area outside the sheet passing area in Zone 1 is (7,265 W/m)×(3/10)=2,179.5≈2,180 (W/m) (rounded off to the first place). In addition, the maximum power for the area outside the sheet passing area in Zone 2 is (7,265 W/m)×(2/10)=1,453≈1,450 (W/m)(rounded off to the first place). Further, the maximum power for the area outside the sheet passing area in Zone 3 is (7,265 W/m)×(1/10)=726.5≈730 (W/m) (rounded off to the first place). Still further, the maximum power for the area outside the sheet passing area in Zone 4 is (7,265 W/m)×(1/10)=726.5≈730 (W/m) (rounded off to the first place).

As shown in Table 6, in the same manner as in Embodiment 1, "(maximum power for the sheet passing area)≥(required power)" is satisfied in each zone, and even in an experiment at the power ratio shown in Table 6, there occurred no poor fixing due to the power shortage. In an actual case, the power supply to the heater 54 is PI-controlled, and hence the maximum power is not supplied to the sheet passing area, and an electric energy close to the required power is supplied on average. In addition, the actual power for the sheet passing area and the actual power for the area outside the sheet passing area shown in Table 6 are calculated by multiplying the power supplied during the passage of the sheet on average by the ratio between the maximum power for the sheet passing area and the maximum power for the area outside the sheet passing area, which is obtained through the calculation.

In addition, the film maximum temperature shown in Table 6 indicates the maximum temperature of the surface of the film 51 in each zone. From the viewpoint of heat resistance, it is preferred that the film 51 constantly maintain its temperature lower than 250° C. during the printing. When the printing is performed for a long time with the surface temperature of the film 51 exceeding 250° C., there is a fear in that the film 51 may be deformed. In Embodiment 2, 240° C. was set as a film threshold temperature by taking a margin. As long as the surface temperature of the film 51 was lower than the film threshold temperature, the other members of the fixing apparatus 50, for example, the pressure roller 53 and the heater 54, did not deform.

[Power Ratio in Case of the Input Voltage 127 V with 40 PPM]

As shown in Table 6, in the control illustrated in Embodiment 2, there is a margin of from 15° C. to 20° C. depending on the zone until the maximum temperature of the film 51 reaches the film threshold temperature (=240° C.). This allows the printing speed of the sheet P to be increased. In view of this, Table 7 is a table for showing, for example, the power ratio and the maximum power in each zone, which were exhibited when the printing speed was increased by reducing an interval time between the preceding sheet and the succeeding sheet and the number of printed sheets P per minute was increased from 30 PPM to 40 PPM. Table 7 is a table obtained by listing the required power, the power ratio between the heat generating elements 54*b*1 and 54*b*3, the maximum power for the sheet passing area, the maximum power for the area outside the sheet passing area, the actual power for the sheet passing area, the actual power for the area outside the sheet passing area, and the maximum temperature of the film 51 in each zone, which are exhibited when the input voltage is 127 V (40 PPM).

TABLE 7

| Zone | Required power (W/m) | Power ratio 54b1 | Power ratio 54b3 | Maximum power for sheet passing area (W/m) | Maximum power for area outside sheet passing area (W/m) | Actual power for sheet passing area (W/m) | Actual power for area outside sheet passing area (W/m) | Film maximum termperature |
|---|---|---|---|---|---|---|---|---|
| 1 | 4,570 | 3 | 7 | 4,620 | 2,180 | 4,610 | 2,170 | 233 |
| 2 | 4,050 | 7 | 8 | 4,250 | 1,450 | 4,100 | 1,400 | 234 |
| 3 | 3,560 | 1 | 9 | 3,870 | 730 | 3,460 | 680 | 232 |
| 4 | 3,150 | 1 | 9 | 3,870 | 730 | 3,100 | 580 | 230 |

In Table 7, as the PPM increases from 30 PPM to 40 PPM, the required power in each zone increases. For example, the required power in Zone 1 has increased from 4,440 W/m to 4,570 W/m, and the required power in Zone 2 has increased from 3,920 W/m to 4,050 W/m. In the same manner, the required power in Zone 3 has increased from 3,420 W/m to 3,560 W/m, and the required power in Zone 4 has increased from 3,020 W/m to 3,150 W/m. As a result, the actual power for the sheet passing area and the actual power for the area outside the sheet passing area have also increased, but the maximum temperature of the film 51 maintains its temperature equal to or lower than the film threshold temperature of 240° C. irrespective of an increase by 8° C. to 10° C. depending on the zone compared to the case of 30 PPM. The power ratio in the case of 40 PPM is the same as the power ratio in the case of 30 PPM (Table 6), and hence the maximum power for the sheet passing area and the maximum power for the area outside the sheet passing area are the same as those in the case of 30 PPM. In this manner, when it is determined that the input voltage calculated by the input voltage calculation sequence has increased, the power ratio of the heat generating element (heat generating elements **54*b*1** in Table 6 and Table 7) having a longer length in the longitudinal direction is decreased. Thus, it is possible to suppress the non-sheet-passing portion temperature rise, to thereby improve the productivity. In Embodiment 2, the PPM is increased by reducing the interval time between the preceding sheet and the subsequent sheet, but may be increased by, for example, increasing the processing speed.

[Setting of Power Ratio Corresponding to Input Voltage]

Table 8 shows power ratios between the heat generating elements **54*b*1 and 54*b*3**, which correspond to specific input voltages.

TABLE 8

| | Input voltage detection result | | | | | | | |
|---|---|---|---|---|---|---|---|---|
| | Lower than 110 V | | 110 V or higher and lower than 120 V | | 120 V or higher and lower than 130 V | | 130 V or higher | |
| Zone | 54b1 Power ratio | 54b3 Power ratio | 54b1 Power ratio | 54b3 Power ratio | 54b1 Power ratio | 54b3 Power ratio | 54b1 Power ratio | 54b1 Power ratio |
| 1 | 10 | 0 | 7 | 3 | 3 | 7 | 2 | 8 |
| 2 | 8 | 2 | 5 | 5 | 2 | 8 | 1 | 9 |
| 3 | 6 | 4 | 3 | 7 | 1 | 9 | 1 | 9 |
| 4 | 4 | 6 | 2 | 8 | 1 | 9 | 1 | 9 |

Table 8 is a table for showing the power ratios between the heat generating elements **54*b*1 and 54*b*3, which correspond to the detection results of the input voltages from the AC power source 55 calculated through use of the input voltage calculation sequence in each zone. The input voltages are classified into four voltages, namely, lower than 110 V, 110 V or higher and lower than 120 V, 120 V or higher and lower than 130 V, and 130 V or higher. The power ratio between the heat generating elements 54*b*1 and 54*b*3 in the case of the input voltage being lower than 110 V conforms to Table 4 of Embodiment 1, and the power ratio between the heat generating elements 54*b* and 54*b*3 with the input voltage being 110 V or higher and lower than 120 V conforms to Table 2 of Embodiment 1. In addition, the power ratio between the heat generating elements 54*b*1 and 54*b*3** with the input voltage being 120 V or higher and lower than 130 V conforms to Table 6 of Embodiment 2.

As described above, in Embodiment 2, when determining that the input voltage from the AC power source 55 obtained by the input voltage calculation sequence has decreased, the CPU 94 increases the power ratio of the heat generating element having the longer length in the longitudinal direction. Meanwhile, when determining that the input voltage from the AC power source 55 obtained by the input voltage calculation sequence has increased, the CPU 94 decreases the power ratio of the heat generating element having the longer length in the longitudinal direction. In Embodiment 2, with such a configuration for controlling the electric energy to be supplied to the heat generating elements, it is possible not only to prevent the occurrence of the poor fixing ascribable to the insufficient electric energy but also to alleviate the non-sheet-passing portion temperature rise to improve the productivity (PPM) of the image forming apparatus 270.

[Effects Produced by Changing Power Ratio Depending on Input Voltage]

Now, the method in each of Embodiments 1 and 2 for changing the power ratio between the heat generating elements depending on the input voltage from the AC power source 55 is compared with an example of a method of avoiding changing the power ratio even when an increase in input voltage is detected (hereinafter referred to as "comparative example"). Note that, description of the same points as those of Embodiment 2 is omitted.

Table 9 is a table for showing, for example, the maximum powers and a non-sheet-passing portion temperature in each zone, which are exhibited when the power ratio is unchanged, even in a case where the input voltage from the AC power source 55 has increased, to maintain the power ratio with the input voltage being 110 V or higher and lower than 120 V. Table 9 shows the maximum power, the power ratio, the maximum powers for the sheet passing area and the area outside the sheet passing area, the actual powers for the sheet passing area and the area outside the sheet passing area, and the maximum temperature of the film 51 (indicated as "non-sheet-passing portion temperature" in Table 9) in each zone, which are exhibited when the printing is performed on the sheet P with the input voltage being 127 V (30 PPM).

TABLE 9

| Zone | Required power (W/m) | Patio ratio 54b1 | Patio ratio 54b3 | Maximum power for sheet passing area (W/m) | Maximum power for area outside sheet passing area (W/m) | Actual power for sheet passing area (W/m) | Actual power for area outside sheet passing area (W/m) | Non-sheet-passing portion termperature (° C.) |
|---|---|---|---|---|---|---|---|---|
| 1 | 4,440 | 7 | 3 | 6,130 | 5,090 | 4,460 | 3,700 | 238 |
| 2 | 3,920 | 5 | 5 | 5,380 | 3,630 | 3,920 | 2,650 | 236 |
| 3 | 3,420 | 3 | 7 | 4,620 | 2,180 | 3,420 | 1,610 | 237 |
| 4 | 3,020 | 2 | 8 | 4,250 | 1,450 | 3.020 | 1,030 | 238 |

The maximum power for the sheet passing area in each zone is obtained with reference to Expression 9. With reference to Table 9, the power ratio between the heat generating elements **54*b*1 and 54*b*3 in Zone 1 is 7:3. Therefore, in accordance with Expression 1, (maximum power for sheet passing area)=(7,265 W/m)×(7/10)+(3,491 W/m)×(3/10)=5,085.5+1,047.3=6,132.8≈6,130 (W/m) (rounded off to the first place). In addition, with reference to Table 9, the power ratio between the heat generating elements 54*b*1 and 54*b*3 in Zone 2 is 5:5. Therefore, in accordance with Expression 1, (maximum power for sheet passing area)=(7,265 W/m)×(5/10)+(3,491 W/m)×(5/10)=3,632.5+21,745.5=5,378≈5,380 (W/m) (rounded off to the first place). Further, with reference to Table 9, the power ratio between the heat generating elements 54*b*1 and 54*b*3 in Zone 3 is 3:7. Therefore, in accordance with Expression 1, (maximum power for sheet passing area)=(7,265 W/m)×(3/10)+(3,491 W/m)×(7/10)=2,179.5+2,443.7=4,623.2≈4,620 (W/m) (rounded off to the first place). Still further, with reference to Table 9, the power ratio between the heat generating elements 54*b*1 and 54*b*3** in Zone 4 is 2:8. Therefore, in accordance with Expression 1, (maximum power for sheet passing area)=(7,265 W/m)×(2/10)+(3,491 W/m)×(8/10)=1,453+2,792.8=4,245.8≈4,250 (W/m) (rounded off to the first place).

Similarly, with reference to Table 9, the maximum power for the area outside the sheet passing area is obtained. The maximum power for the area outside the sheet passing area in Table 9 is calculated by (maximum power of heat generating elements **54*b*1)×(power ratio of heat generating elements 54*b*1**). Therefore, the maximum power for the area outside the sheet passing area in Zone 1 is (7,265 W/m)×(7/10)=5,085.5≈5,090 (W/m) (rounded off to the first place). In addition, the maximum power for the area outside the sheet passing area in Zone 2 is (7,265 W/m)×(5/10)=3,632.5≈3,630 (W/m) (rounded off to the first place). Further, the maximum power for the area outside the sheet passing area in Zone 3 is (7,265 W/m)×(3/10)=2,179.5≈2,180 (W/m) (rounded off to the first place). Similarly, the maximum power for the area outside the sheet passing area in Zone 4 is (7,265 W/m)×(2/10)=1,453≈1,450 (W/m) (rounded off to the first place).

In addition, the actual power for the sheet passing area and the actual power for the area outside the sheet passing area shown in Table 9 are calculated by multiplying the power supplied during the passage of the sheet on average by the ratio between the maximum power for the sheet passing area and the maximum power for the area outside the sheet passing area, which is obtained through the calculation. The actual powers for the sheet passing area in Zones 1 to 4 shown in Table 9 are 4,460 W/m, 3,920 W/m, 3,420 W/m, and 3,020 W/m, respectively. Meanwhile, the actual powers for the sheet passing area in Zones 1 to 4 shown in Table 6 of Embodiment 2, in which the printing is performed on the sheet P with the input voltage being 127 V (30 PPM) under the same conditions as those in Table 9, are 4,470 W/m, 3,960 W/m, 3,460 W/m, and 3,100 W/m, respectively. The actual powers for the sheet passing area are substantially the same power between the case of Embodiment 2 and the case of the comparative example, and have caused no difference. Meanwhile, the actual powers for the area outside the sheet passing area in Zones 1 to 4 shown in Table 9 are 3,700 W/m, 2,650 W/m, 1,610 W/m, and 1,030 W/m, respectively. Meanwhile, the actual powers for the area outside the sheet passing area in Zones 1 to 4 shown in Table 6 of Embodiment 2, in which the printing is performed on the sheet P with the input voltage being 127 V (30 PPM) under the same conditions as those in Table 9, are 2,120 W/m, 1,360 W/m, 650 W/m, and 580 W/m, respectively. The actual powers for the area outside the sheet passing area have caused a large difference between the case of Embodiment 2 and the case of the comparative example.

As shown in Table 9, a relationship between the required power and the maximum power for the sheet passing area in each zone satisfies a magnitude relationship of "(required power)<(maximum power for the sheet passing area)", and there occurs no poor fixing due to the power shortage. Meanwhile, the maximum temperature of the film 51 is higher than that in Table 6 of Embodiment 2 by 12° C. (Zone 2) to 18° C. (Zone 4).

Figures 14A, 14B, 14C:
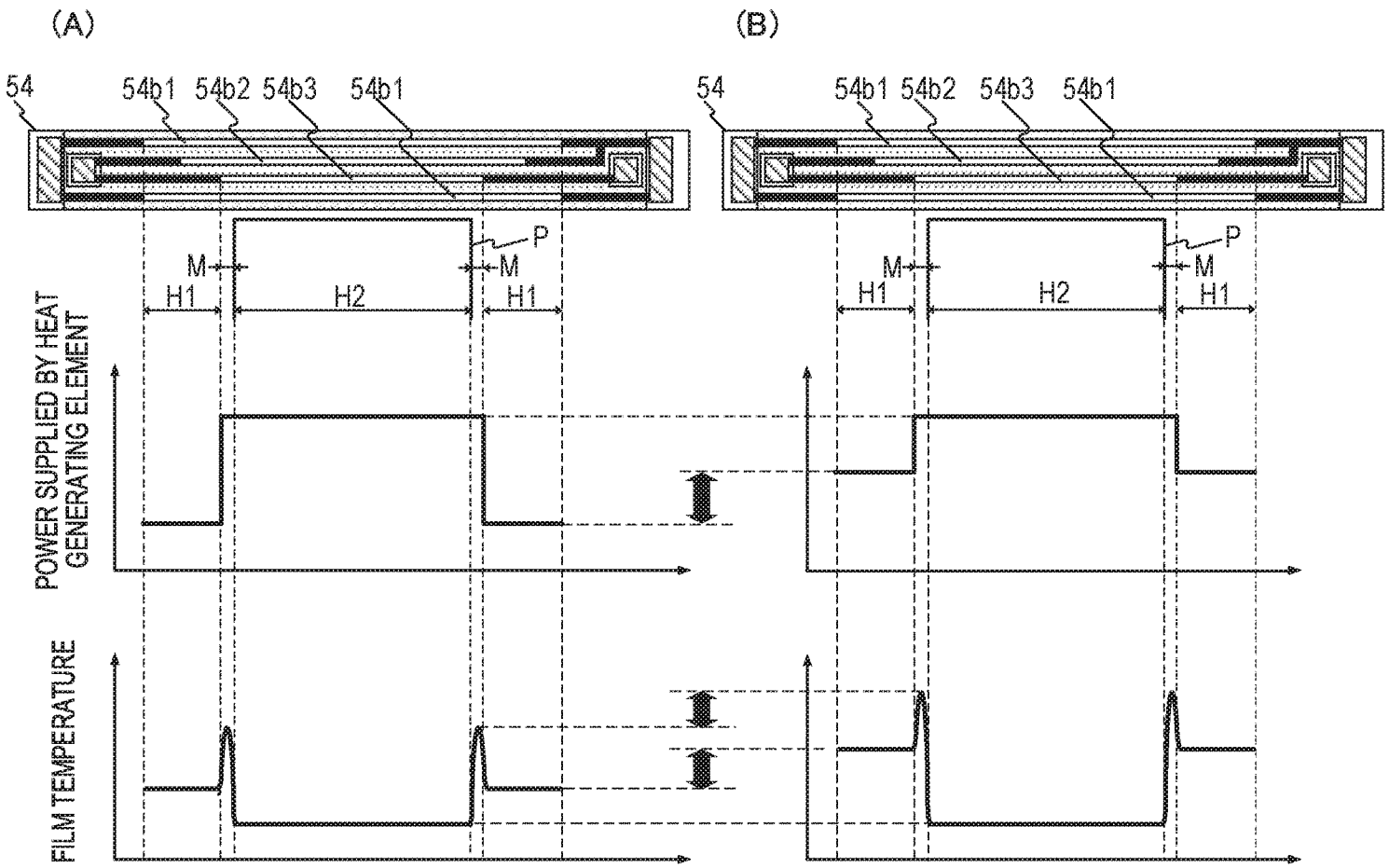
FIG. 14A, FIG. 14B, and FIG. 14C are diagrams for comparing a positional relationship in the longitudinal direction between the heater and the film temperature between Embodiment 2 and the comparative example.

The reason for the above-mentioned fact is described with reference to FIG. 14A, FIG. 14B, and FIG. 14C. In the same manner as in FIG. 13A, FIG. 14A is a diagram for illustrating a positional relationship between the configuration of the heat generating elements 54*b*1, 54*b*2, and 54*b*3 of the heater 54 and the sheet P. In addition, in FIG. 14B, the electric energy supplied to the film 51 by the heat generating elements 54*b*1 and 54*b*3 of the heater 54 is illustrated, the horizontal axis represents the position with respect to the film 51, and the vertical axis represents the electric energy supplied by the heat generating elements 54*b*1 and 54*b*3. In FIG. 14C, a conceptual image of the film temperature of the film 51 to which the electric energy illustrated in FIG. 14B is supplied is illustrated, the horizontal axis represents the position with respect to the film 51, and the vertical axis represents the film temperature. In addition, FIG. 14A to FIG. 14C are divided into two parts, namely, part (A) illustrated on the left side of FIG. 14A to FIG. 14C, and part (B) illustrated on the right side of FIG. 14A to FIG. 14C. Part (A) indicates a configuration in the case of Embodiment 2, and part (B) indicates a configuration in the case of the comparative example. In the following description, parts (A) and (B) are referred to as "Configuration A" and "Configuration B", respectively. In Configuration A and Configuration B, conditions other than the power ratio shown in Table 9 are set to be the same conditions.

As illustrated in FIG. 14A and FIG. 14B, in both Configuration A and Configuration B, the range in the longitudinal direction in which the temperature of the film 51 reaches the maximum temperature overlaps with Range M. In this case, the power within Range H2 illustrated in FIG. 14B is the power supplied to the film 51 by the heat generating elements 54*b*1 and 54*b*3, and is the power supplied (applied) to the sheet P as heat when the sheet P passes through the film 51, and this power is the same for both Configuration A and Configuration B. In the same manner as in Range H2, as the power in Range M, the same power is supplied from the heat generating elements 54*b* and 54*b*3 to the film 51.

Meanwhile, as illustrated in FIG. 14B, the power in Range H1 is higher in Configuration B than in Configuration A. This is because the power ratio of the heat generating elements 54*b*1 is larger in Configuration B than in Configuration A. Therefore, the film temperature in Range H1 illustrated in FIG. 14C is also higher in Configuration B. As illustrated in FIG. 14C, the film temperature in Range H2 through which the sheet P passes is the same in both Configuration A and Configuration B, but the film temperature in Range H1 is higher in Configuration B, and hence the temperature in Range M adjacent to Range H1 is also higher in Configuration B than in Configuration A.

It has thus turned out that, in the case of the comparative example (Configuration B) of avoiding changing the power ratio depending on the input voltage, a temperature rise is higher in the non-sheet-passing portion including Range H1 and Range M than that in Embodiment 2 (Configuration A). It has become clear that the configuration (Configuration A) in Embodiment 2 has an effect of alleviating the non-sheet-passing portion temperature rise compared to the configuration (Configuration B) in the comparative example.

As described above, when it is determined by the input voltage calculation sequence that the input voltage has increased, it is possible to alleviate the non-sheet-passing portion temperature rise by changing the power ratio. In addition, it is possible to improve the productivity of the image forming apparatus 270 by changing the printing speed of the sheet P while changing the power ratio. Further, in Embodiment 2, the input voltage from the AC power source 55 can be calculated more accurately through use of the input voltage calculation sequence using the current detection circuit. Still further, through determination of the power ratio based on Expression 2, it is possible to appropriately change the power ratio in accordance with the change in input voltage, and to obtain a more desired heat distribution in the longitudinal direction of the heater 54.

As described above, according to Embodiment 2, it is possible to switch the power supply to the heat generating elements depending on the change in input voltage.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-162956, filed Sep. 6, 2019, which is hereby incorporated by reference herein in its entirety.

What is claimed is:

1. A heating apparatus configured to heat an image borne on a recording material, the heating apparatus comprising:

a heater portion including a plurality of heat generating elements, which includes a first heat generating element and a second heat generating element, which has a length shorter than a length of the first heat generating element in a longitudinal direction, and has a resistance value larger than a resistance value of the first heat generating element in an entirety;

a power source configured to supply power to the plurality of heat generating elements of the heater portion;

a switching unit configured to switch a connection between the power source and at least one of the first heat generating element or the second heat generating element;

a control unit configured to control the switching unit to switch power supply to the plurality of heat generating elements; and a voltage detection unit configured to detect an input voltage input from the power source to the plurality of heat generating elements, wherein the control unit is configured to switch a power ratio, which is a ratio between an electric energy supplied from the power source to the first heat generating element and an electric energy supplied from the power source to the second heat generating element, depending on the input voltage detected by the voltage detection unit.

2. The heating apparatus according to claim 1, wherein, in a case in which the input voltage detected by the voltage detection unit has increased, the control unit switches the power ratio to decrease the electric energy supplied to the first heat generating element.

3. The heating apparatus according to claim 1, wherein, in a case in which the input voltage detected by the voltage detection unit has decreased, the control unit switches the power ratio to increase the electric energy supplied to the first heat generating element.

4. The heating apparatus according to claim 3, wherein the control unit is configured to set, as a power ratio of the first heat generating element, a smallest value among values of "x" that satisfy the following expression:

$$\frac{V^2}{R1}\frac{1}{L1}x + \frac{V^2}{R2}\frac{1}{L2}(1-x) \geqq W$$

where V represents a voltage detected by the voltage detection unit, R1 represents the resistance value of the first heat generating element, L1 represents the length of the first heat generating element in the longitudinal direction, R2 represents the resistance value of the second heat generating element, L2 represents the length of the second heat generating element in the longitudinal direction, "x" represents the power ratio of the first heat generating element, and W represents a power required for heating the recording material.

5. The heating apparatus according to claim 4, wherein the power ratio "x" of the first heat generating element is larger than 0.

6. The heating apparatus according to claim 5, further comprising a temperature detection unit configured to detect a temperature of the heater portion, wherein the voltage detection unit is configured to detect the input voltage based on (i) the power supplied to the first heat generating element during a time elapsed after the temperature of the first heat generating element detected by the temperature detection unit starts to increase from a first temperature until the temperature reaches a second temperature, which is higher than the first temperature, and (ii) the resistance value of the first heat generating element.

7. The heating apparatus according to claim 5, further comprising a current detection unit configured to detect a current flowing from the power source to the heater portion, wherein the voltage detection unit is configured to calculate the input voltage based on a current value detected by the current detection unit and the resistance value of the first heat generating element.

8. The heating apparatus according to claim 6, further comprising a substrate on which the heater portion is arranged, wherein the substrate is elongated, wherein the heater portion further includes a third heat generating element having a length shorter than the length of the second heat generating element in the longitudinal direction, wherein the first heat generating element includes a pair of heat generating elements having substantially a same length in the longitudinal direction, and wherein the first heat generating element, the second heat generating element, the third heat generating element, and a return to the first heat generating element are arranged in order of mention in a widthwise direction of the substrate perpendicular to both the longitudinal direction of the substrate and a thickness direction of the substrate.

9. The heating apparatus according to claim 8, wherein the substrate includes:

a first contact electrically connected to one end of the first heat generating element and one end of the second heat generating element, a second contact electrically connected to one end of the third heat generating element, a third contact electrically connected to another end of the second heat generating element and another end of the third heat generating element, and a fourth contact electrically connected to another end of the first heat generating element.

10. The heating apparatus according to claim 9, wherein the switching unit includes:

a supply control portion, which is provided on a power supply route between the power source and the fourth contact and a power supply route between the power source and each of a relay and the second contact, and is configured to control power supply to the heater portion by connecting and disconnecting power supply routes, and the relay, wherein the relay is configured to switch between a connection between the power source and the third contact and a connection between the supply control portion and the third contact.

11. The heating apparatus according to claim 8, wherein the control unit is configured to:

switch a power ratio between the first heat generating element and the second heat generating element in a case where the heating apparatus heats the recording material according to the length of the second heat generating element in the longitudinal direction, and switch a power ratio between the first heat generating element and the third heat generating element in a case where the heating apparatus heats the recording material according to the length of the third heat generating element in the longitudinal direction.

12. A fixing apparatus configured to fix an unfixed toner image borne on a recording material, the fixing apparatus comprising:

a heating apparatus that includes:

a heater portion including a plurality of heat generating elements, which includes a first heat generating element and a second heat generating element, which has a length shorter than a length of the first heat generating element in a longitudinal direction, and has a resistance value larger than a resistance value of the first heat generating element in an entirety;

a power source configured to supply power to the plurality of heat generating elements of the heater portion;

a switching unit configured to switch a connection between the power source and at least one of the first heat generating element or the second heat generating element;

a control unit configured to control the switching unit to switch power supply to the plurality of heat generating elements;

a voltage detection unit configured to detect an input voltage input from the power source to the plurality of heat generating elements, wherein the control unit is configured to switch a power ratio, which is a ratio between an electric energy supplied from the power source to the first heat generating element and an electric energy supplied from the power source to the second heat generating element, depending on the input voltage detected by the voltage detection unit;

a first rotary member to be heated by the heater portion; and a second rotary member configured to form a nip portion together with the first rotary member.

13. The fixing apparatus according to claim 12, wherein the first rotary member comprises a film.

14. The fixing apparatus according to claim 13, wherein the heater portion is provided to be in contact with an inner surface of the film, and wherein the nip portion is formed by sandwiching the film between the heater portion and the second rotary member.

15. An image forming apparatus comprising:

an image forming unit configured to form a toner image on a recording material; and a fixing apparatus configured to fix an unfixed toner image borne on the recording material, wherein the fixing apparatus includes a heating apparatus, wherein the heating apparatus includes:

a heater portion including a plurality of heat generating elements, which includes a first heat generating element and a second heat generating element, which has a length shorter than a length of the first heat generating element in a longitudinal direction, and has a resistance value larger than a resistance value of the first heat generating element in an entirety, a power source configured to supply power to the plurality of heat generating elements of the heater portion, a switching unit configured to switch a connection between the power source and at least one of the first heat generating element or the second heat generating element, a control unit configured to control the switching unit to switch power supply to the plurality of heat generating elements, a voltage detection unit configured to detect an input voltage input from the power source to the plurality of heat generating elements, wherein the control unit is configured to switch a power ratio, which is a ratio between an electric energy supplied from the power source to the first heat generating element and an electric energy supplied from the power source to the second heat generating element, depending on the input voltage detected by the voltage detection unit, a first rotary member to be heated by the heater portion, and a second rotary member configured to form a nip portion together with the first rotary member.

* * * * *